US008439211B2

(12) United States Patent
Emrani et al.

(10) Patent No.: US 8,439,211 B2
(45) Date of Patent: May 14, 2013

(54) VISUAL ORGANIZATION AND DISPLAY APPARATUS AND SYSTEM

(75) Inventors: Ray R. Emrani, Los Angeles, CA (US); Gregory E. Mote, Los Angeles, CA (US)

(73) Assignee: Ray R. Emrani, Los Angeles, CA (US)

( * ) Notice: Subject to any disclaimer, the term of this patent is extended or adjusted under 35 U.S.C. 154(b) by 459 days.

(21) Appl. No.: 11/388,469

(22) Filed: Mar. 24, 2006

(65) Prior Publication Data

US 2007/0086840 A1 Apr. 19, 2007

Related U.S. Application Data

(63) Continuation-in-part of application No. 11/229,143, filed on Sep. 16, 2005, now abandoned.

(51) Int. Cl.
*A47F 5/02* (2006.01)

(52) U.S. Cl.
USPC ..... 211/162; 211/94.01

(58) Field of Classification Search ..... 211/46, 211/162, 94.01, 126.13, 11, 34, 45, 47, 87.01, 211/94.02, 121, 122, 168, 169, 169.1; 312/46, 312/201, 125, 135, 202, 305; 108/94, 139, 108/140; 198/803.14, 867.11, 867.14, 867.15
See application file for complete search history.

(56) References Cited

U.S. PATENT DOCUMENTS 605,148 A * 6/1898 Sylvester ..... 40/504
766,660 A * 8/1904 Bohannan ..... 312/201
2,608,305 A * 8/1952 Sager ..... 211/49.1
2,832,389 A * 4/1958 Smith ..... 383/9
4,240,353 A * 12/1980 Barth ..... 104/93
4,360,991 A * 11/1982 West ..... 52/29
4,585,127 A * 4/1986 Benedict ..... 211/34
4,681,232 A * 7/1987 Du Corday ..... 211/46
4,723,819 A * 2/1988 Ramberg ..... 312/130
5,057,977 A * 10/1991 Kurzman ..... 362/125
5,062,536 A * 11/1991 Tsai ..... 211/162
5,072,838 A * 12/1991 Price et al. ..... 211/162
5,076,442 A * 12/1991 Hakeem ..... 211/34
5,094,414 A * 3/1992 Eddy, Jr. ..... 248/95
5,127,721 A * 7/1992 Inden ..... 312/249.9
5,139,155 A * 8/1992 Laxson ..... 211/169
5,207,335 A * 5/1993 Voelz ..... 211/122
5,405,193 A * 4/1995 Herrenbruck ..... 312/118
5,511,675 A * 4/1996 Frederick ..... 211/193
5,680,938 A * 10/1997 Rubinstein ..... 211/42
5,899,343 A * 5/1999 Franklin et al. ..... 211/85.2
6,340,092 B1 * 1/2002 McGrath, Jr. ..... 211/169
6,484,893 B1 * 11/2002 Tkatch ..... 211/94.02
6,681,941 B1 * 1/2004 Johnson ..... 211/86.01
7,204,372 B2 * 4/2007 Kin et al. ..... 211/45
7,640,131 B2 * 12/2009 Ono et al. ..... 702/108

* cited by examiner

*Primary Examiner* — Darnell Jayne
*Assistant Examiner* — Joshua Rodden
(74) *Attorney, Agent, or Firm* — Blakely, Sokoloff, Taylor & Zafman

(57) ABSTRACT

A system includes a panel, a holder removably connected to the panel. The holder includes at least one connecting portion. A removable slide hanger has a first portion rotatably connected to the panel and slidably connected to a frame. Content placed in the holder is viewable.

9 Claims, 38 Drawing Sheets

VISUAL ORGANIZATION AND DISPLAY APPARATUS AND SYSTEM

This Application is a continuation-in-part of U.S. patent application Ser. No. 11/229,143, which was filed on Sep. 16, 2005 now abandoned entitled "VISUAL ORGANIZATION AND DISPLAY APPARATUS AND SYSTEM" by Ray R. Emrani and Gregory E. Mote, and commonly assigned to the assignee of the present invention, the disclosure of which is expressly and fully incorporated herein by reference.

BACKGROUND

1. Field

The embodiments relate to visual organization and display apparatus and systems, and more particularly to visualized and expandable organization and display systems.

2. Description of the Related Art

Filing systems that exist today typically include filing cabinets, where files are placed out of site; filing compartments, where files are placed within a compartment, out of sight; or placed on filing stands, where folders can easily be misplaced, hidden, fall (emptying contents), etc. As folders/files increase in size, multiple files that are associated must be moved at the same time or placed together in a filing cabinet, shelf or compartment. It is easy for these files to get separated.

The existing organization systems, such as filing systems, rely on tags or alphabetical identification. A problem with these organization systems is if something is placed in a wrong compartment, file or folder, it can take quite some time to find the item as the items are hidden from view.

SUMMARY

One embodiment of a system includes a panel, a holder removably connected to the panel. The holder includes at least one connecting portion. A removable slide hanger has a first portion rotatably connected to the panel and slidably connected to a frame. Content placed in the holder is viewable.

Another embodiment includes a visual organization apparatus. The visual organization apparatus includes a first storage device having at least one storage compartment, a plurality of first coupling portions, and a panel having a connector portion. The plurality of first coupling portions removably couple with the connector portion.

Yet another embodiment includes a system comprising a plurality of holders. Each of the plurality of holders includes means for removably connecting to a panel. A hanger device is coupled to the panel and a frame. A rail device is coupled to a coupling device on the bottom of the panel. The panel is adapted to rotate and slide on the frame.

BRIEF DESCRIPTION OF THE DRAWINGS

The embodiments are illustrated by way of example, and not by way of limitation, in the figures of the accompanying drawings and in which like reference numerals refer to similar elements and in which.

DETAILED DESCRIPTION OF THE INVENTION

The invention generally relates to visual organization/display systems.

Referring to the figures, exemplary embodiments of the invention will now be described. The exemplary embodiments are provided to illustrate the invention and should not be construed as limiting the scope of the invention.

Figure 1:
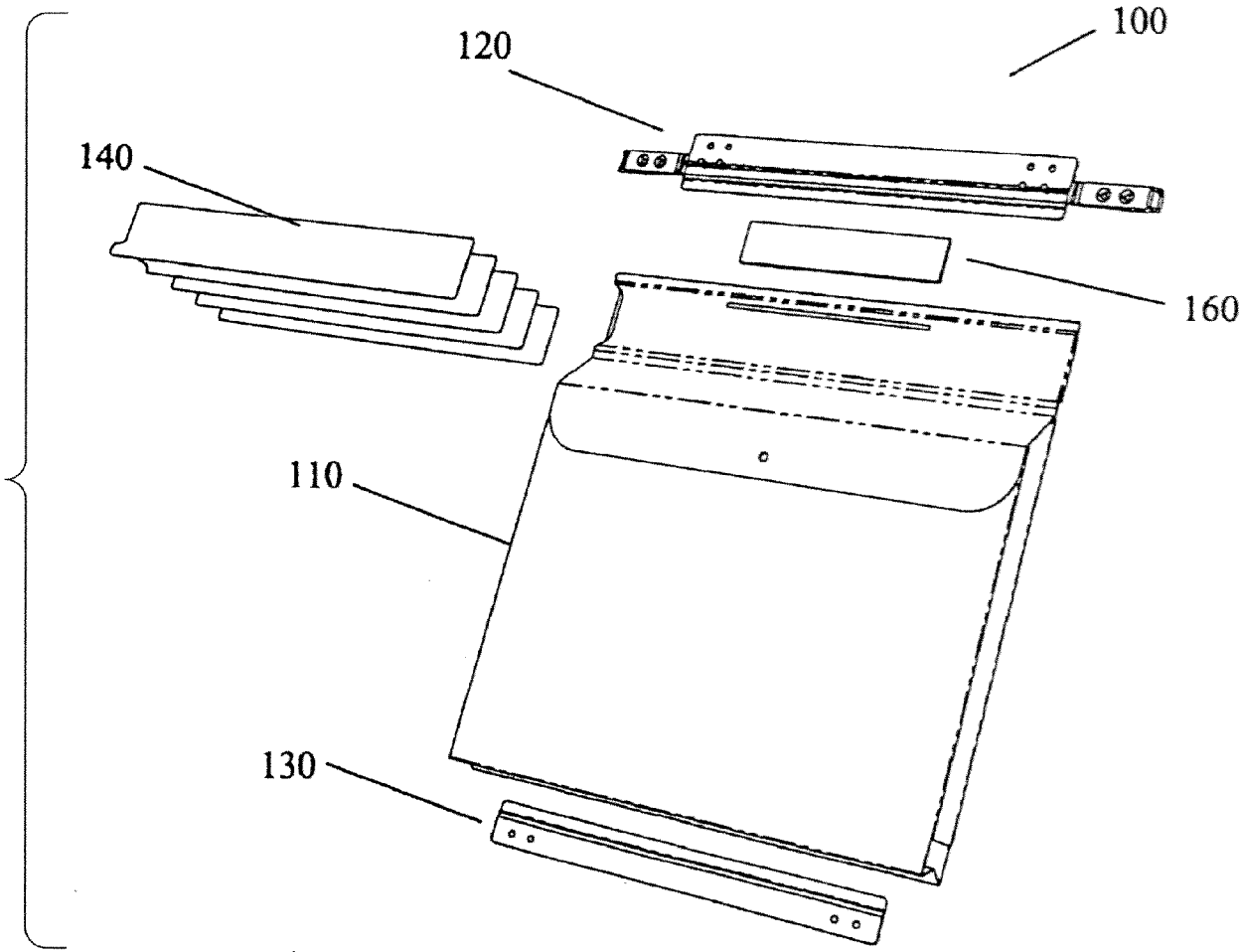
FIG. 1 illustrates an exploded view of an embodiment of an organization system.

FIG. 1 illustrates an embodiment of visual organization system 100.

Visual organization system 100 includes first holder 110. In one embodiment first holder 110 includes first connecting portion 120 and second connecting portion 130. A second holder 110 (see FIGS. 11, 12A, 12B, 15, 16, 17, 18, 19, 21, 22 and 23) can be removably connected to either first connecting portion 120 or second connecting portion 130 of first holder 110. In one embodiment removable slide hanger 905 (see FIG. 9A) is rotatably connected to either first holder 110 or second holder 110.

In one embodiment first holder 110 and second holder 110 each includes at least one changeable color coded insert 140 and note insert 160. In on embodiment, color coded insert is used to display stowed object information, such as a product description, product benefits, sale price, etc.

In one embodiment first holder 110 and second holder 110 are each made of a clear material so that objects stored/displayed within the first holder 110 and/or the second holder 110 can be displayed or seen. In one embodiment, the clear material is plastic, vinyl, plexi glass, strong cellophane, etc. In another embodiment, the clear material is expandable. In one embodiment first holder 110 includes a folding portion that is removably connected to a body portion. In one embodiment, a snap type connector is used to connect the flap portion to the body portion. In another embodiment, a clasp connector is used. Is should be noted that other embodiments can implement other known connecting means to connect the flap portion to the body portion.

In one embodiment, changeable color coded insert(s) 140 allows a user to code holders (e.g., first holder 110) for different purposes. For example, different colors can be for different types of projects, different priorities, different prices, different objects, etc.

Figure 2:
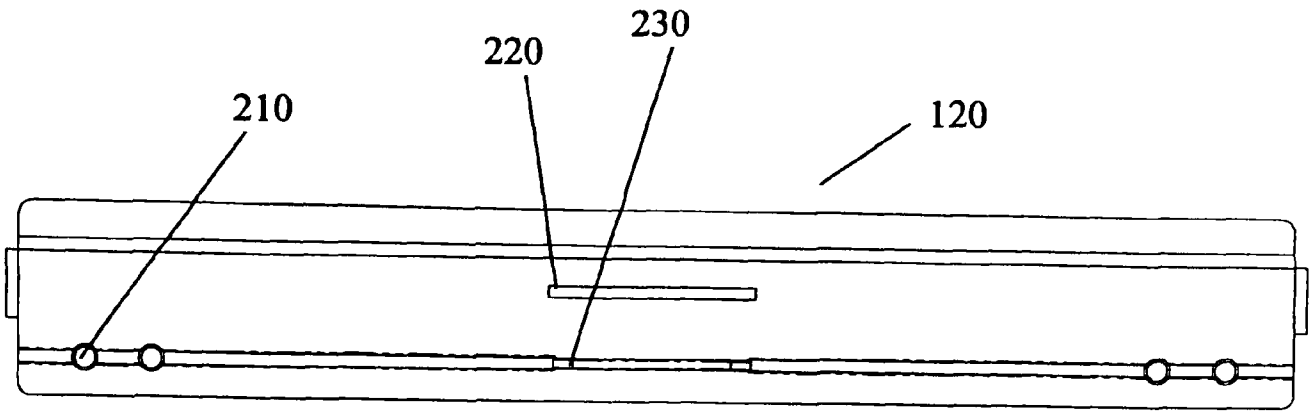
FIG. 2 illustrates a back view of a first connecting device of the embodiment illustrated in FIG. 1.

FIG. 2 illustrates a rear view of first connecting portion 120. In one embodiment, first connecting portion 120 includes a plurality of coupling pins 210 (shown in FIG. 2 as projecting into the page). In one embodiment, first connecting portion 120 includes four (4) coupling pins 210. In other embodiments, other number of coupling 210 pins can be implemented (e.g., two (2), six (6), eight (8), etc.). In one embodiment first connecting portion 120 includes through-opening 220. In another embodiment, groove 230 allows a complimentary fit for another connecting portion (e.g., another connecting portion 120) having fitment portion 325 (see FIG. 3). In one embodiment, first connecting portion 120 is made of a plastic, a polymer, etc.

Figure 3:
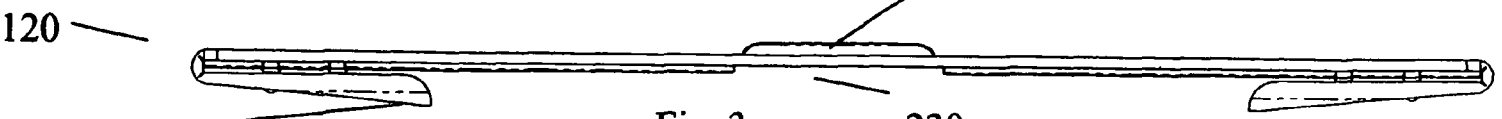
FIG. 3 illustrates a side view of a first connecting device of the embodiment illustrated in FIG. 1.
Figure 4:
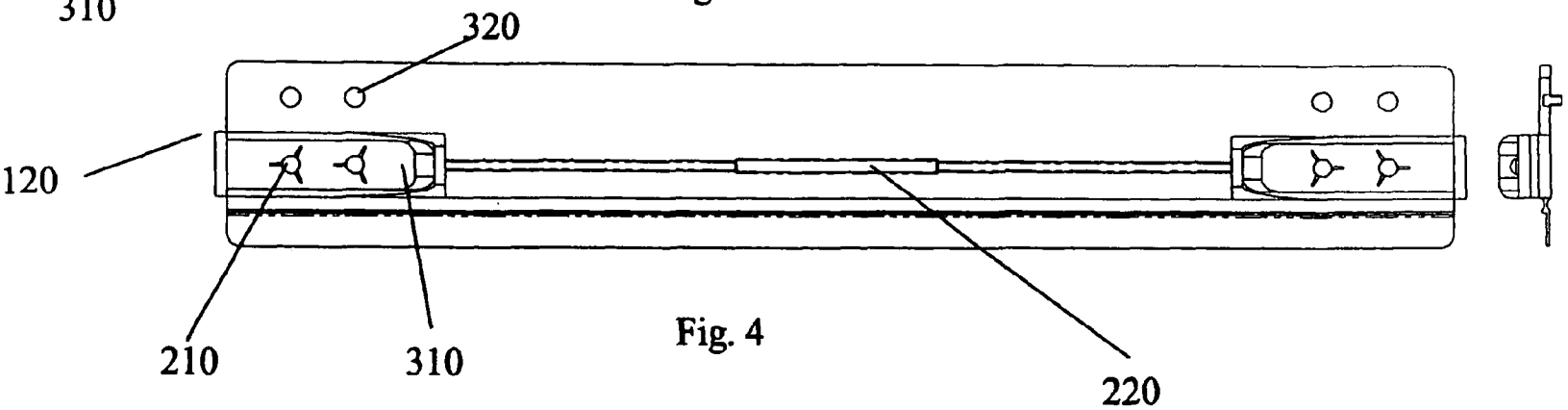
FIG. 4 illustrates a front view of a first connecting device of the embodiment illustrated in FIG. 1.

FIG. 3 illustrates a top side view of first connecting portion 120. In one embodiment first connecting portion 120 includes at least two snap couplers 310. Snap couplers 310 hold other first connecting portions 120 or second connecting portions 130 on coupling pins 210. FIG. 4 illustrates a front view of first connecting portion 120. As illustrated snap couplers 310 snap over coupling pins 210 and hold in place based on friction. First connecting portion 120 includes a plurality of through-holes 320. In one embodiment, four (4) through-holes 320 are included in first connecting portion 120. It should be noted that other number of through-holes 320 can be implemented in other embodiments, such as two (2), six (6), etc.

Figures 5A, 5B:
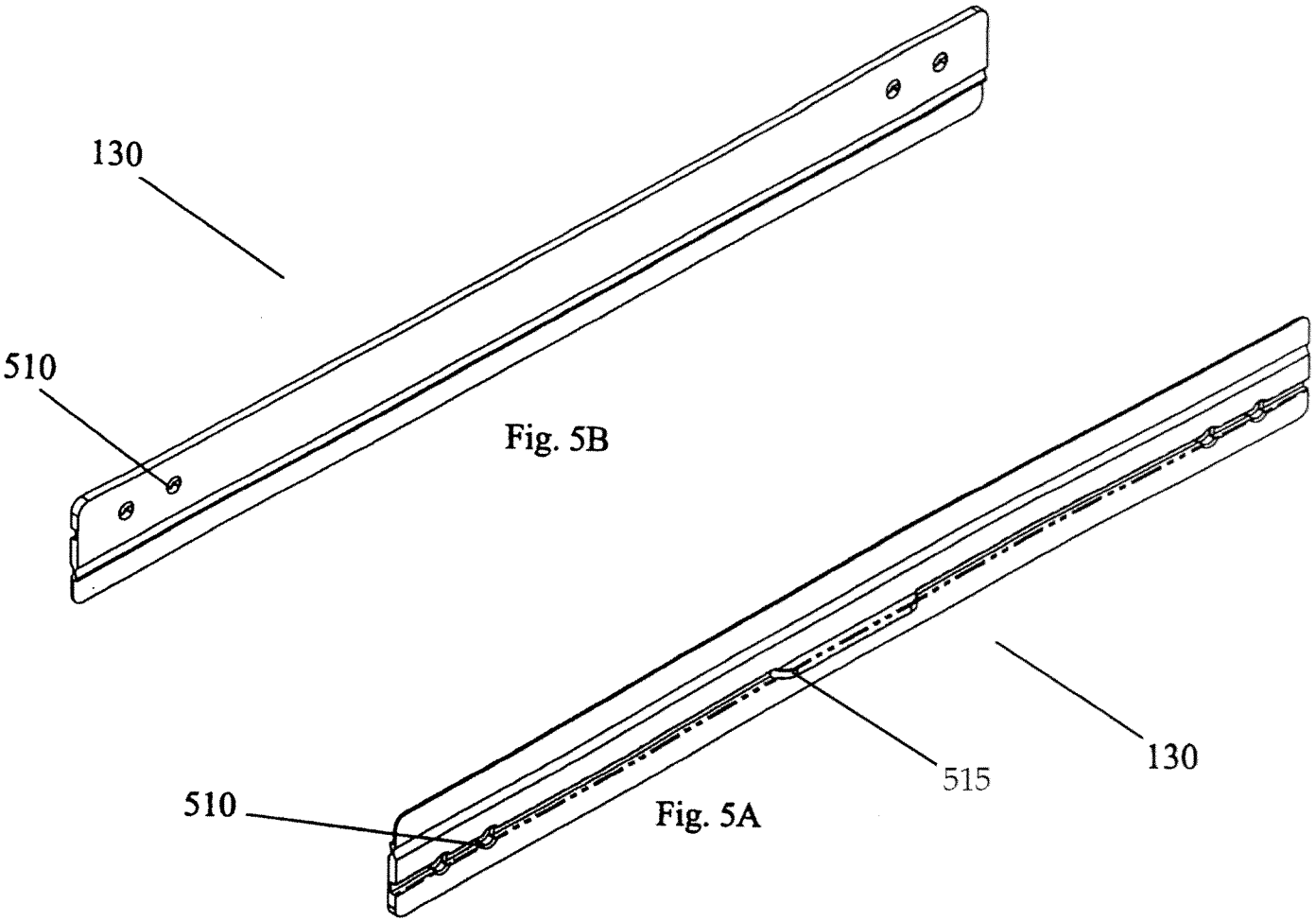
FIG. 5A illustrates a front view of a second connecting device of the embodiment illustrated in FIG. 1.
FIG. 5B illustrates a back view of a second connecting device of the embodiment illustrated in FIG. 1.

FIG. 5A illustrates a rear view of second connecting portion 130. FIG. 5B illustrates a front view of second connecting portion 130. As illustrated, second coupling portion 130 includes through-holes 510. In one embodiment through-holes 510 connect first connecting portion 120 by inserting connecting pins 210 through through-holes 510. Extension 515 is complimentary to groove 230 and holds first connecting portion 120 in alignment with second connecting portion 130.

Figure 6B:
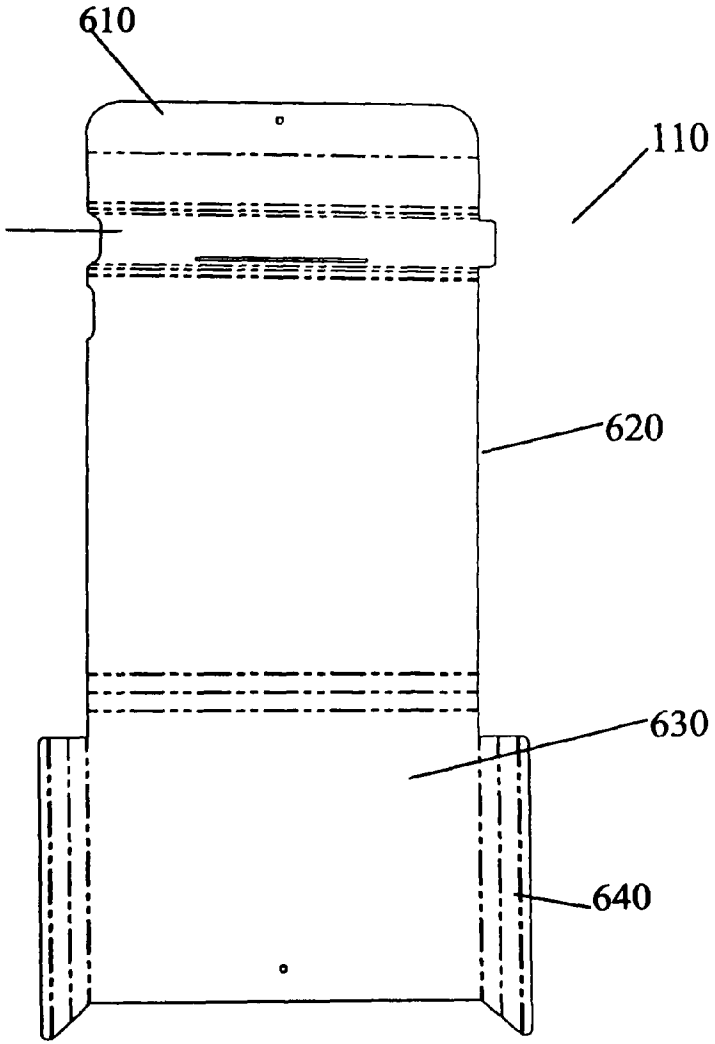
FIG. 6B illustrates a front view of an expanded holder device of the embodiment illustrated in FIG. 1.
Figure 6A:
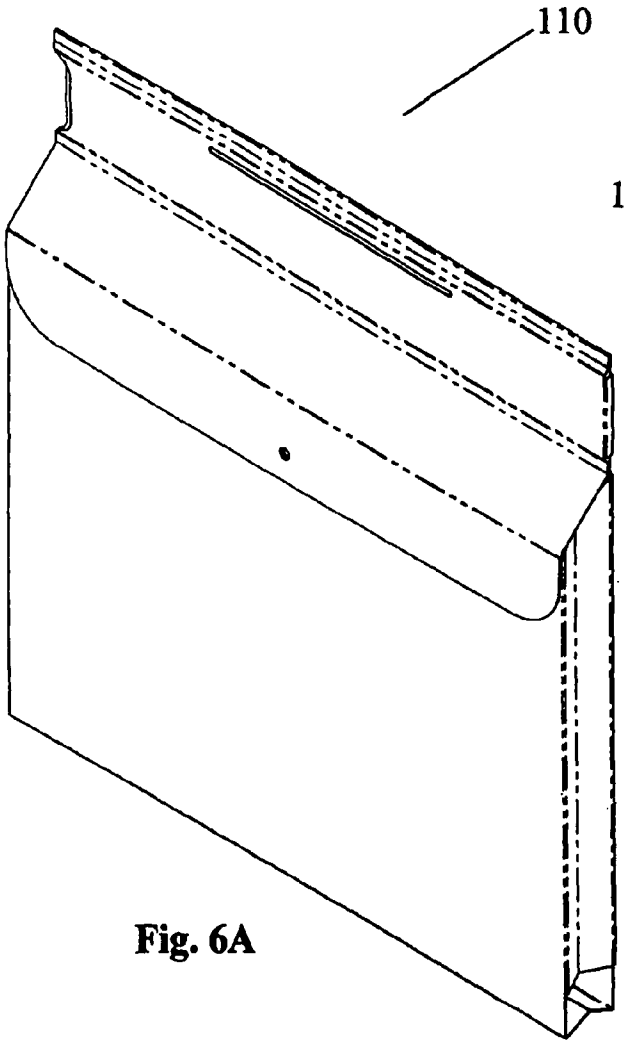
FIG. 6A illustrates a perspective view of a holder device of the embodiment illustrated in FIG. 1.

FIG. 6A illustrates holder 110 in a closed configuration. As illustrated, holder 110 is a collapsible/expandable holder. FIG. 6B illustrates holder 110 in an unfolded configuration. As illustrated, holder 110 includes upper portion 620 (i.e., a first holding portion). In one embodiment, upper portion 620 includes an inner compartment (e.g., a pocket) for filing paper or other items. Lower portion 630 (i.e., a second holding portion) folds away from upper portion 620. In one embodiment lower portion 630 includes an inner compartment (e.g., a pocket) for filing papers or other items. Holding couplers 640 couple to upper portion 620. Overlap portion 610 connects to the front of lower portion 630, which closes first holder 110. In one embodiment, first holder 110 is closed by an adhesive. In another embodiment, first holder 110 is closed by hook and loop fasteners. In one embodiment, first holder is made of a clear material and at least one changeable color coded insert 140 is removably inserted into view area 150. In one embodiment upper portion 620 is contiguous with lower portion 630.

Figure 7:
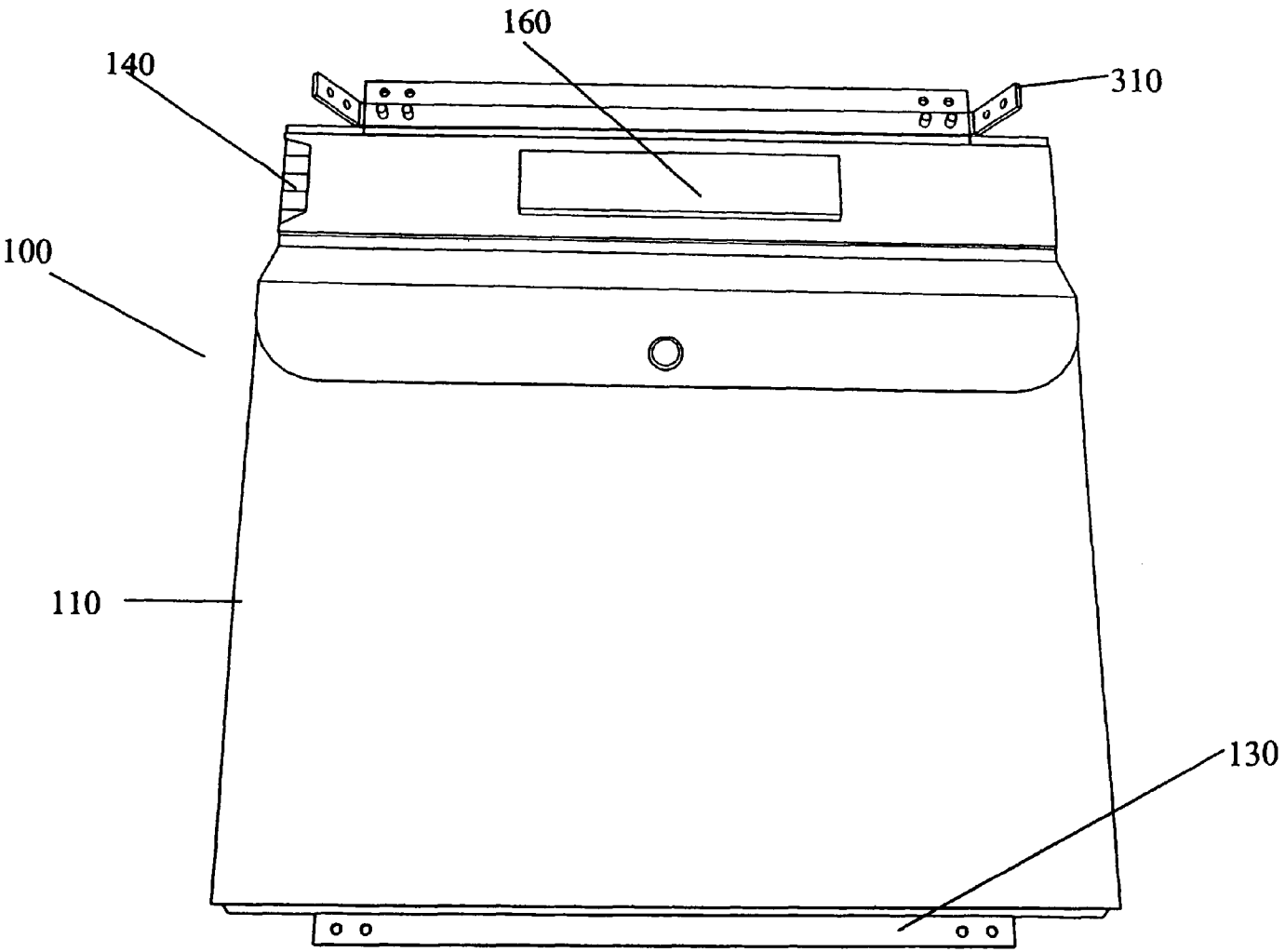
FIG. 7 illustrates an embodiment of a system.

FIG. 7 illustrates an embodiment of visual organization system 100 with its elements connected together. As illustrated when first holder 110 is empty or contains few paper or thin articles, first holder 110 is substantially flat.

Figures 8A, 8B:
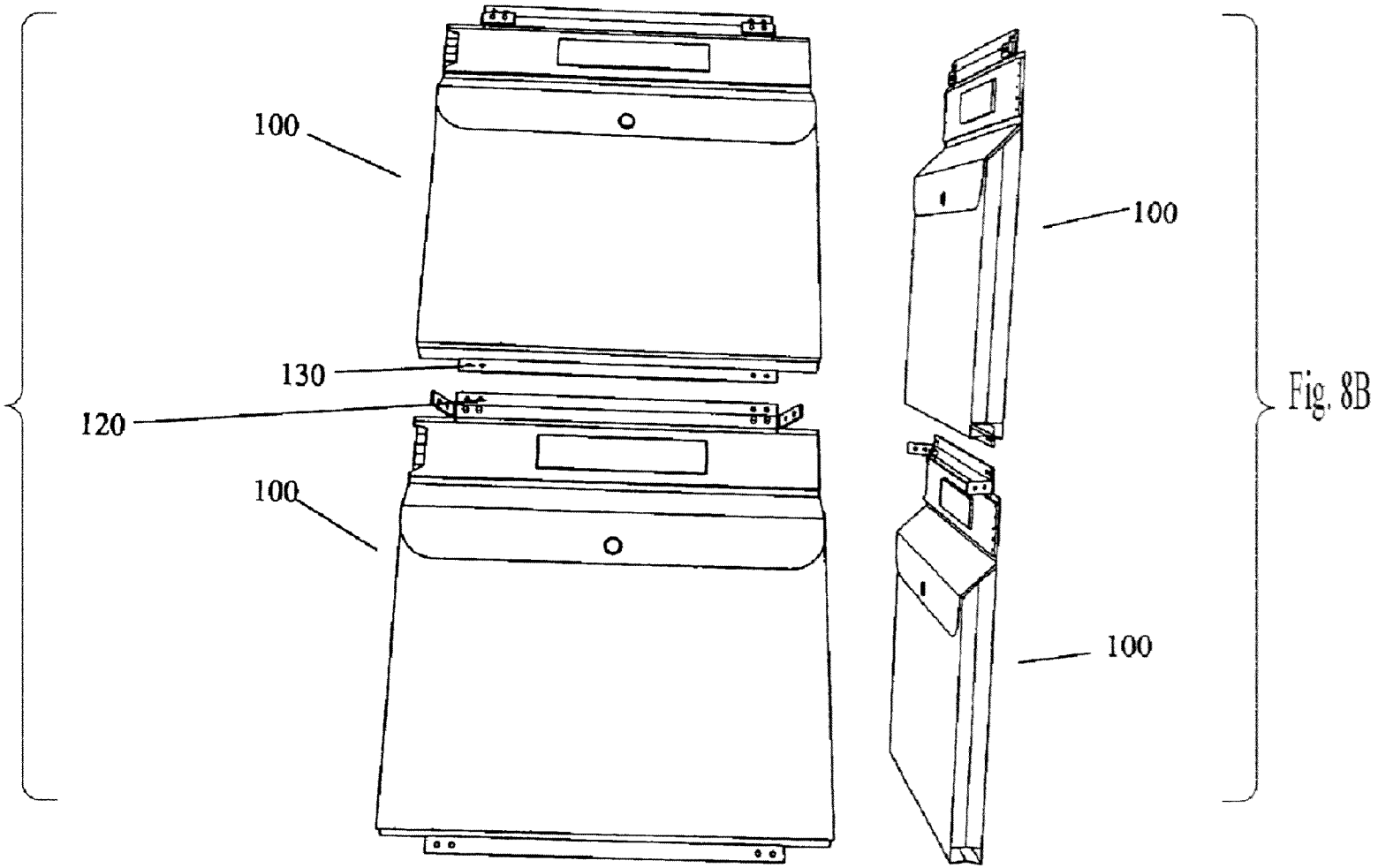
FIG. 8A illustrates a front view of two holder devices of a system of an embodiment.
FIG. 8B illustrates a side view of two holder devices of a system of an embodiment.

FIG. 8A illustrates two visual organization systems 100 a distance from one another before becoming connected. As illustrated through-holes 320 of first connecting portion 120 are set to couple with through-holes 510 of second connecting portion 130. FIG. 8B illustrates a side view of two visual organization systems 100 a distance from one another before becoming connected.

Figures 9A, 9B:
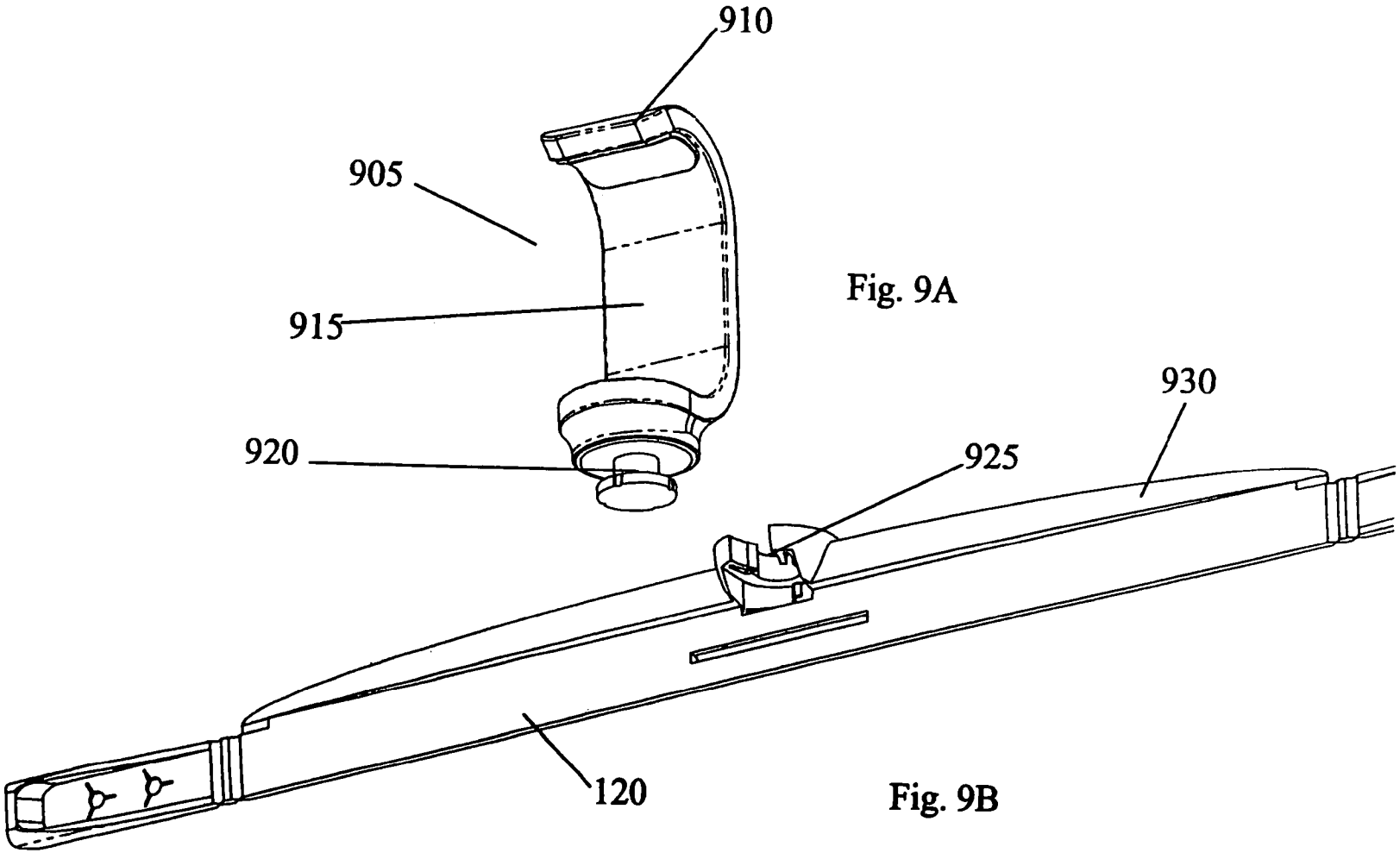
FIG. 9A illustrates a hanger of an embodiment.
FIG. 9B illustrates a hanger connecting portion of an embodiment.

FIG. 9A illustrates a removable slide hanger 905 including curved hanger portion 910, back portion 915 and swivel portion 920. In one embodiment swivel portion 920 removably couples to first connecting portion 120. In one embodiment curved hanger portion 910 and back portion 915 slidably and removably couple to holding rod 1030 (see FIG. 10).

FIG. 9B illustrates hanger bracket 930. Hanger bracket 930 includes swivel connector 925. Hanger bracket 930 connects to first connecting portion 120. Swivel connector 925 snap locks swivel 920 of hanger 905. Swivel 920 allows hanger 905 to rotate 360 degrees while holding visual organization system 100.

Figure 10:
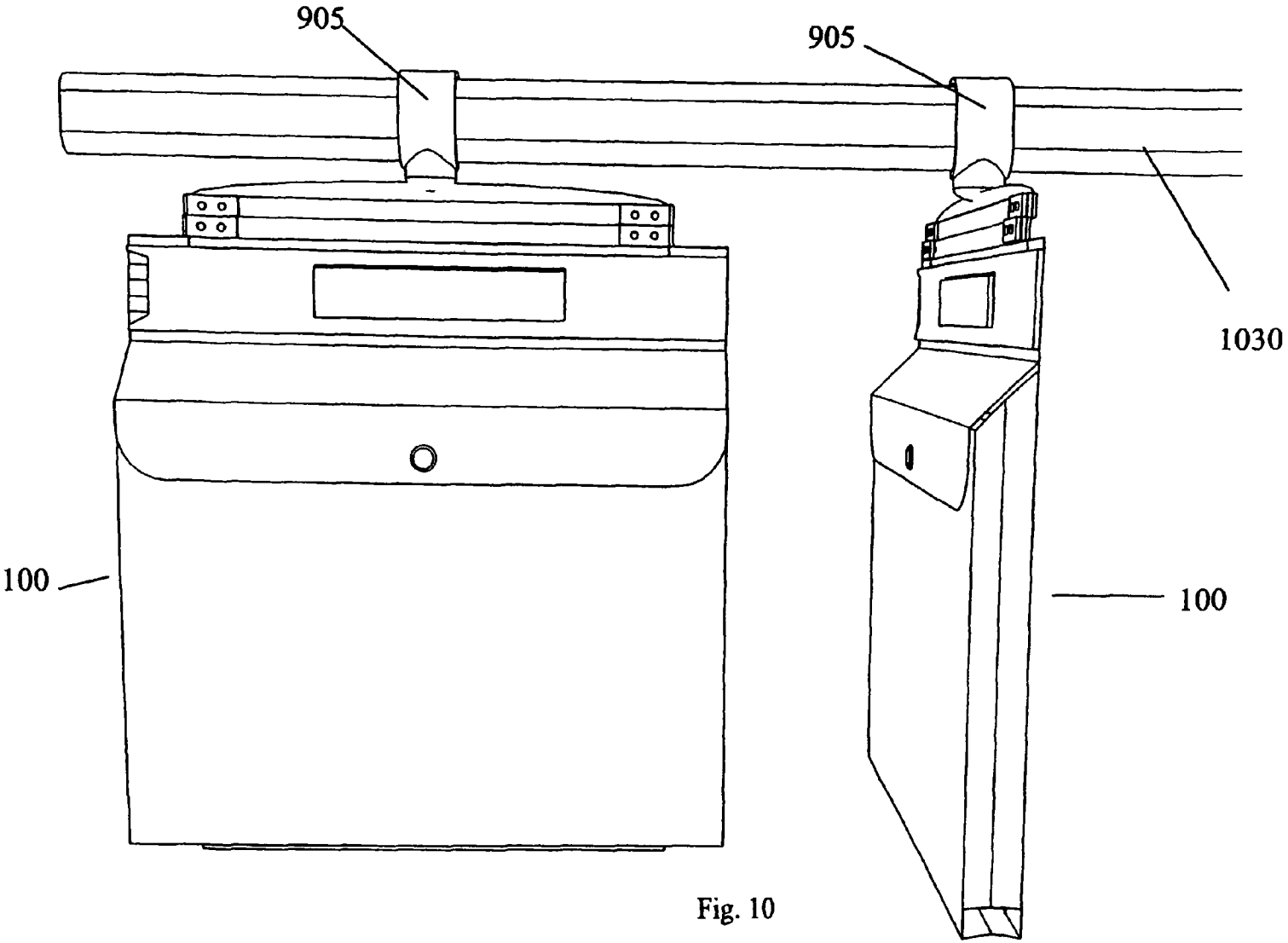
FIG. 10 illustrates two organization holders rotatably coupled to a hanging rod.

FIG. 10 illustrates two visual organization systems 100 each connected to hangers 905, which are connected to hanger brackets 930. As illustrated visual organization holder 100 hangs from rod 1030 and can rotate 360 degrees in relation to hanger 905. When visual organization systems 100 are angled at 90 degrees in relation to hanger 905, visual organization systems 100 can be stored compactly against one another. When visual organization systems 100 are rotated to be parallel with rod 1030, the contents of visual organization system 100 can be seen as first holder 110 is clear and the contents are easily accessible.

Figure 11:
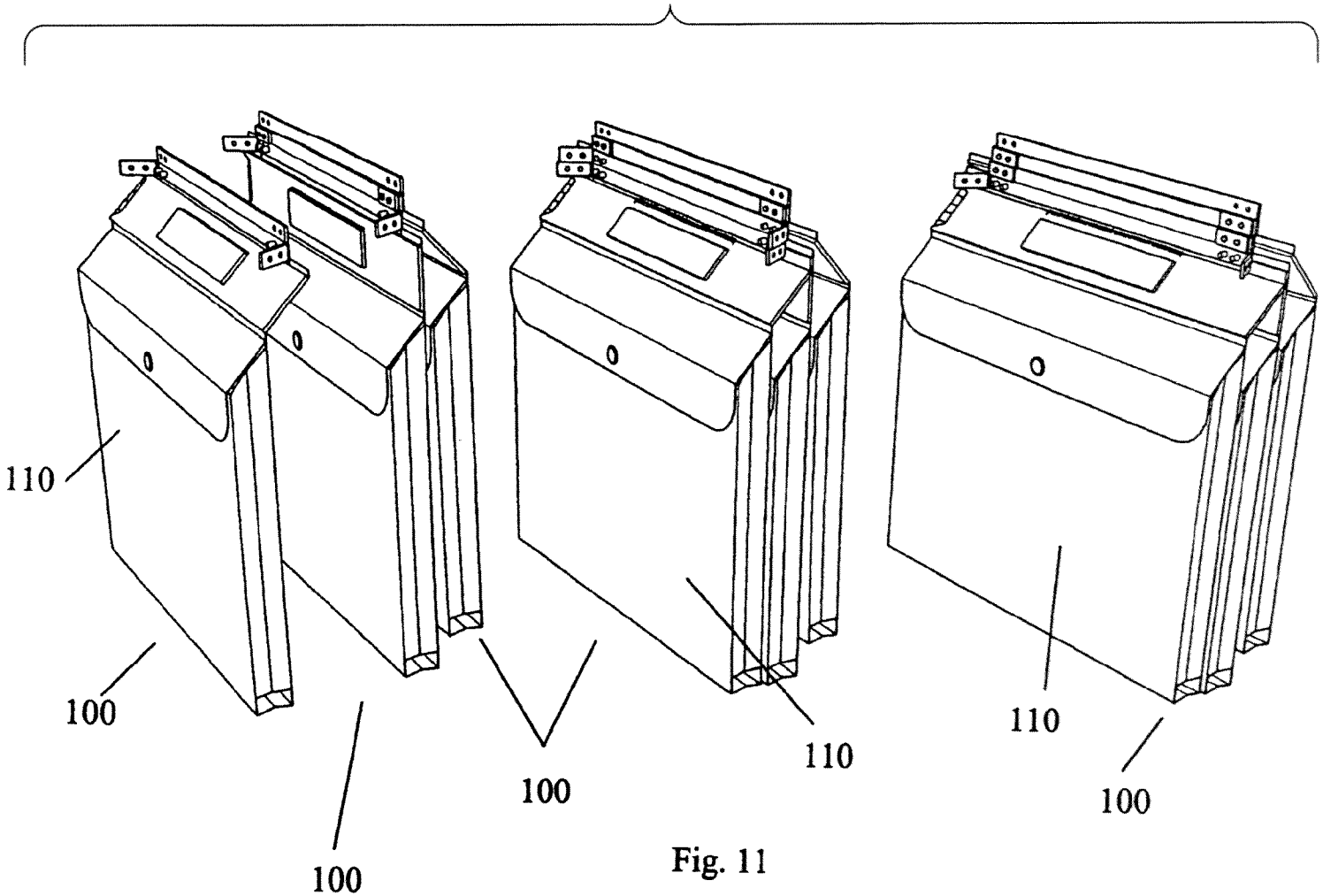
FIG. 11 illustrates multiple holder devices coupled to one another horizontally.

FIG. 11 illustrates multiple visual organization systems 100 horizontally connecting to one another in sequence. As illustrated, first connecting portions 120 of multiple visual organization systems 100 connect to one another through through-holes 320 and connecting pins 210. In one embodiment multiple visual organization systems 100 horizontally connect to one another in back to back order on one side of the first connecting portion 120 and oppositely on the other side.

Figure 12B:
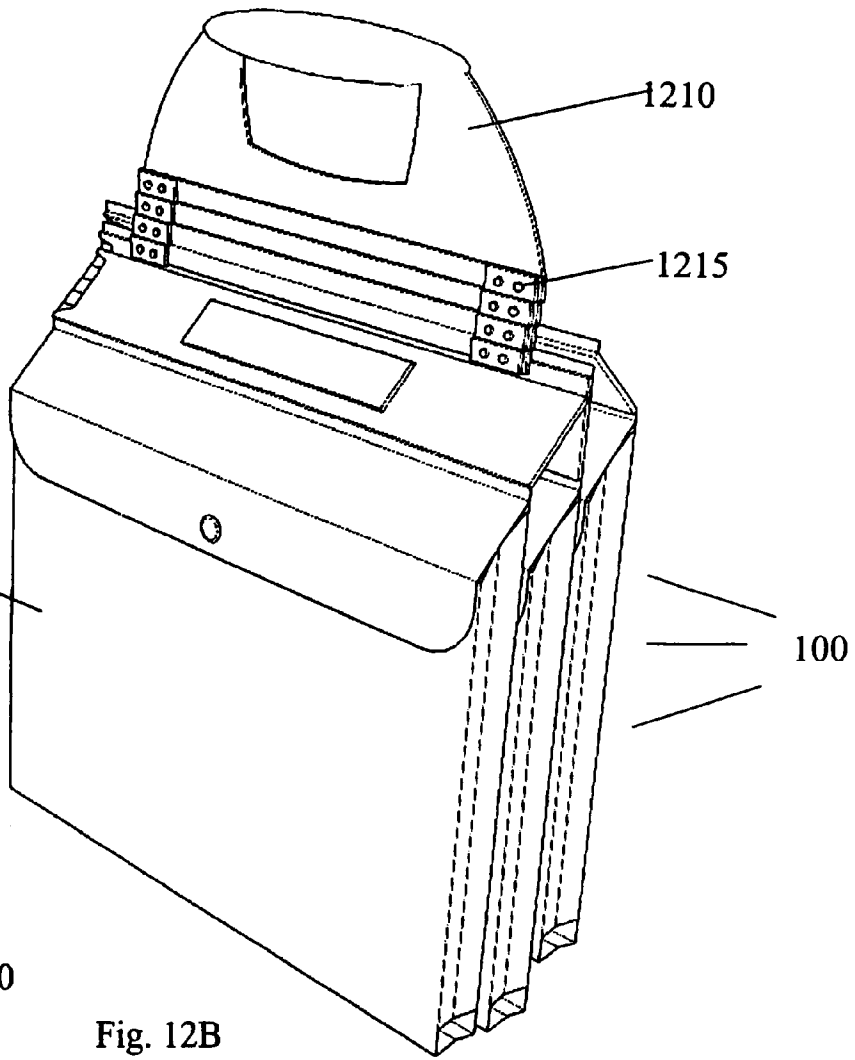
FIG. 12B illustrates a perspective view of multiple holder devices coupled to one another horizontally.
Figure 12A:
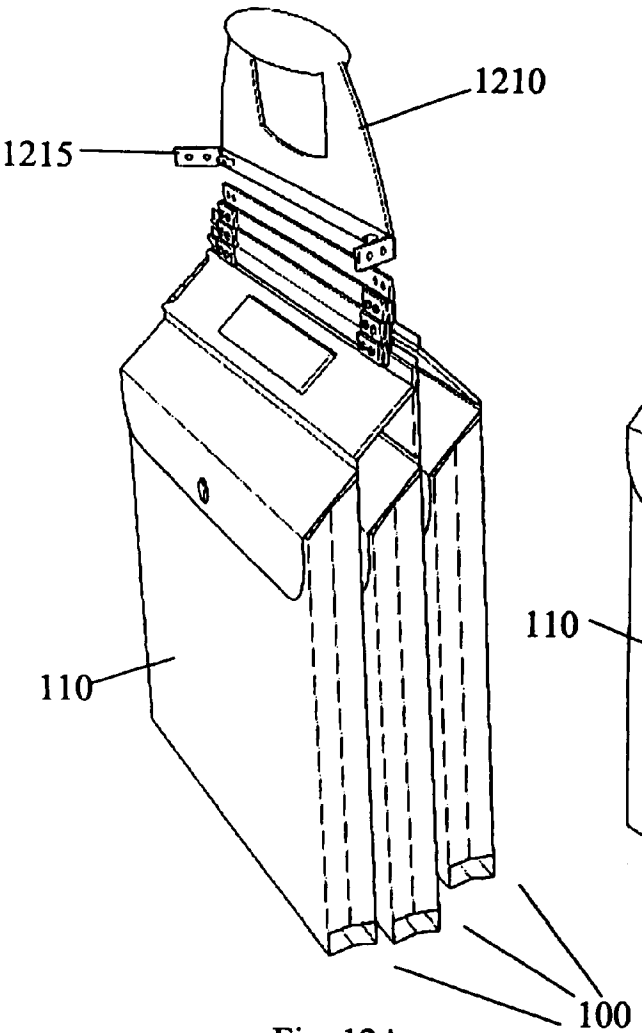
FIG. 12A illustrates a side view of multiple holder devices coupled to one another horizontally.

FIG. 12A illustrates handle 1210 in position connect to one first connecting portion 120 of multiple organization systems 100 that are horizontally connected to one another. FIG. 12B illustrates handle 1210 in connected to one first connecting portion 120 of multiple organization systems 100 that are horizontally connected to one another. As illustrated handle 1210 includes snap connector 1215, which snaps over connecting pins 210.

Figure 13:
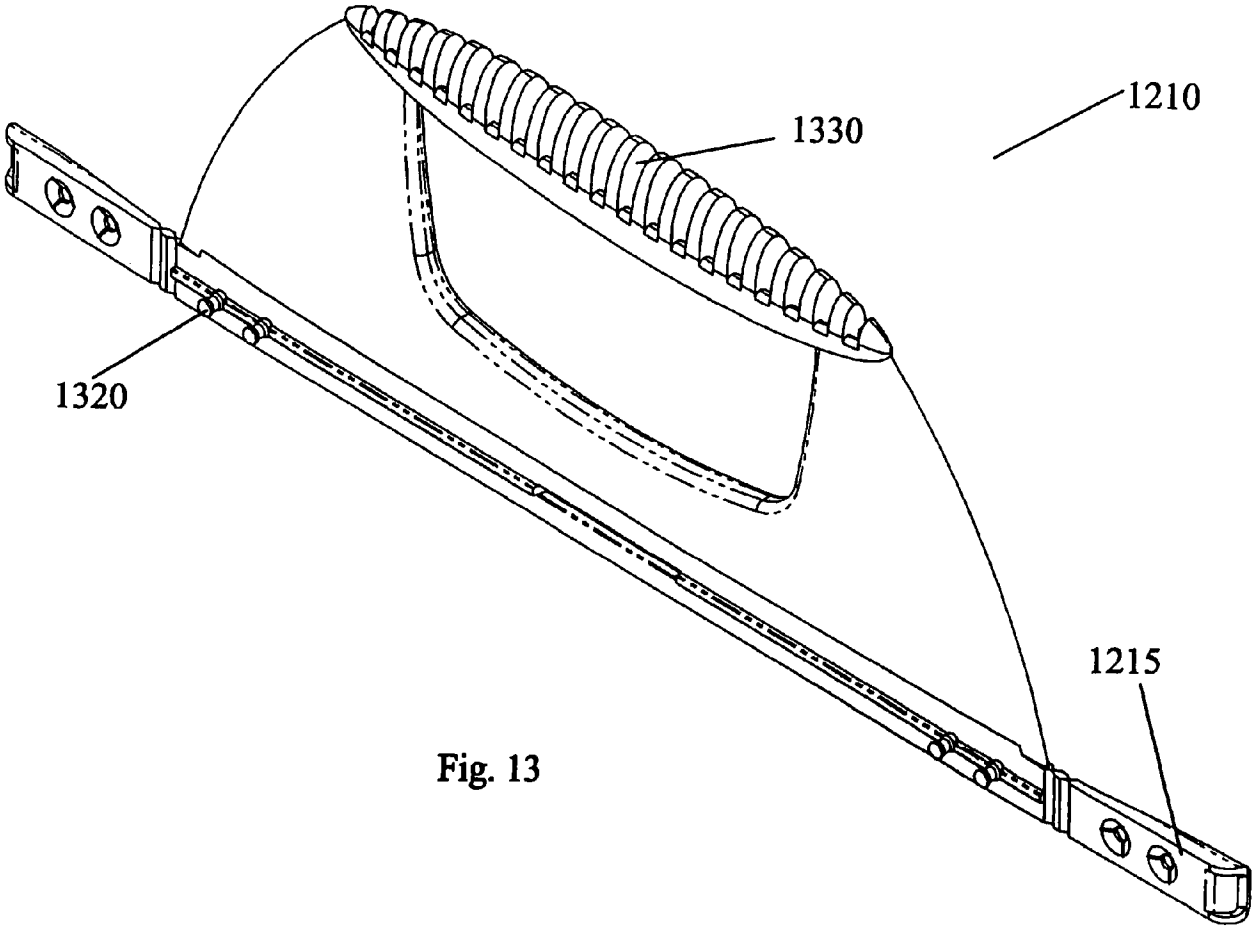
FIG. 13 illustrates a handle device of an embodiment.

FIG. 13 illustrates handle 1210. As illustrated handle 1210 includes grip portion 1330, snap pins 1320 and snap connector 1215. In one embodiment handle 1210 is made of plastic, polymer, fiber, nylon, etc.

Figure 14:
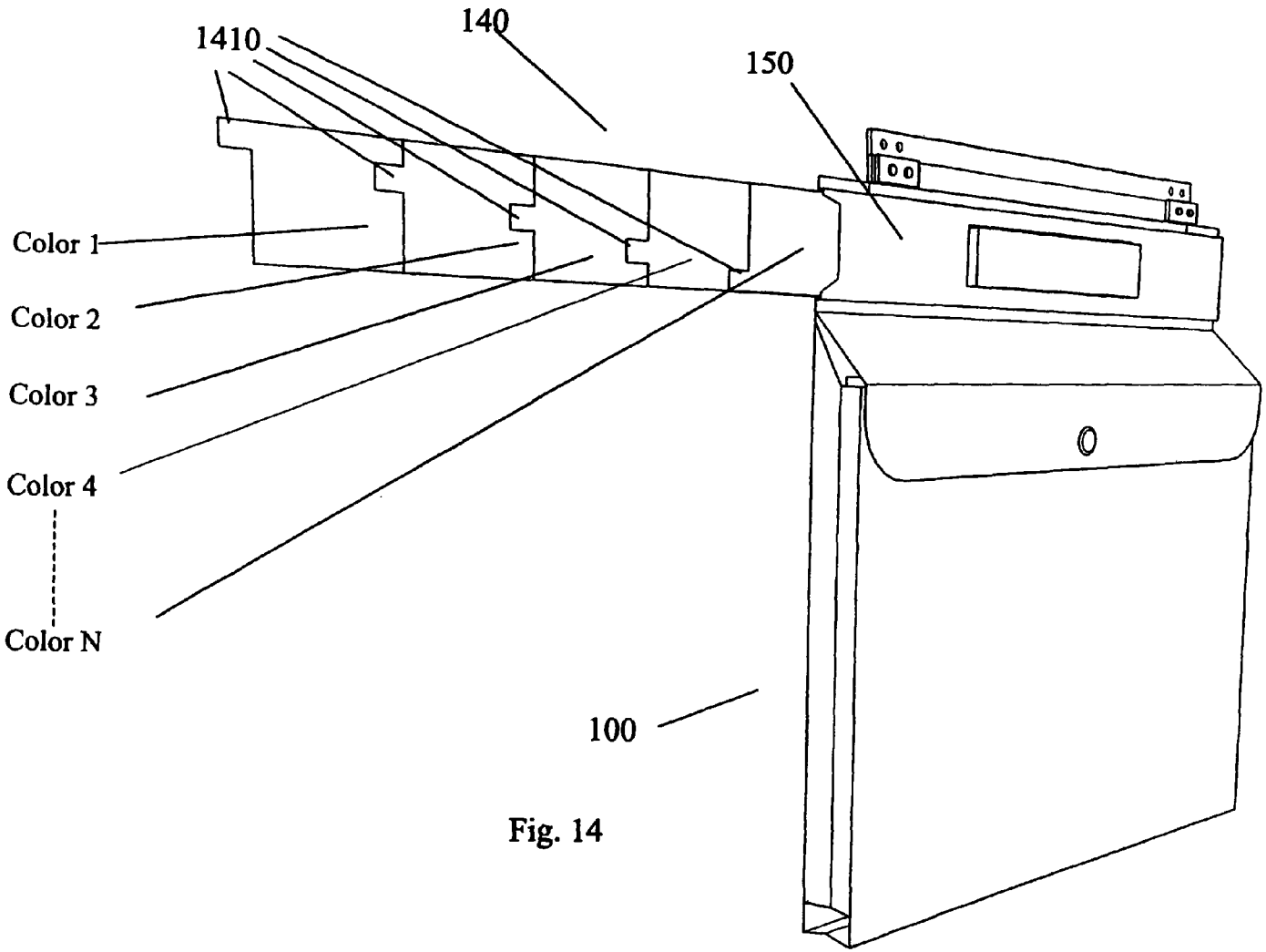
FIG. 14 illustrates a color-coded insert of an embodiment.

FIG. 14 illustrates visual organization system 100 with a plurality of changeable color coded inserts 140 partly inserted into view area 150. In one embodiment, each color coded insert includes an indicator tag 1410 that vary in location based on color. As indicated multiple types of colors for color coded inserts 140 can be used as desired.

Figure 15:
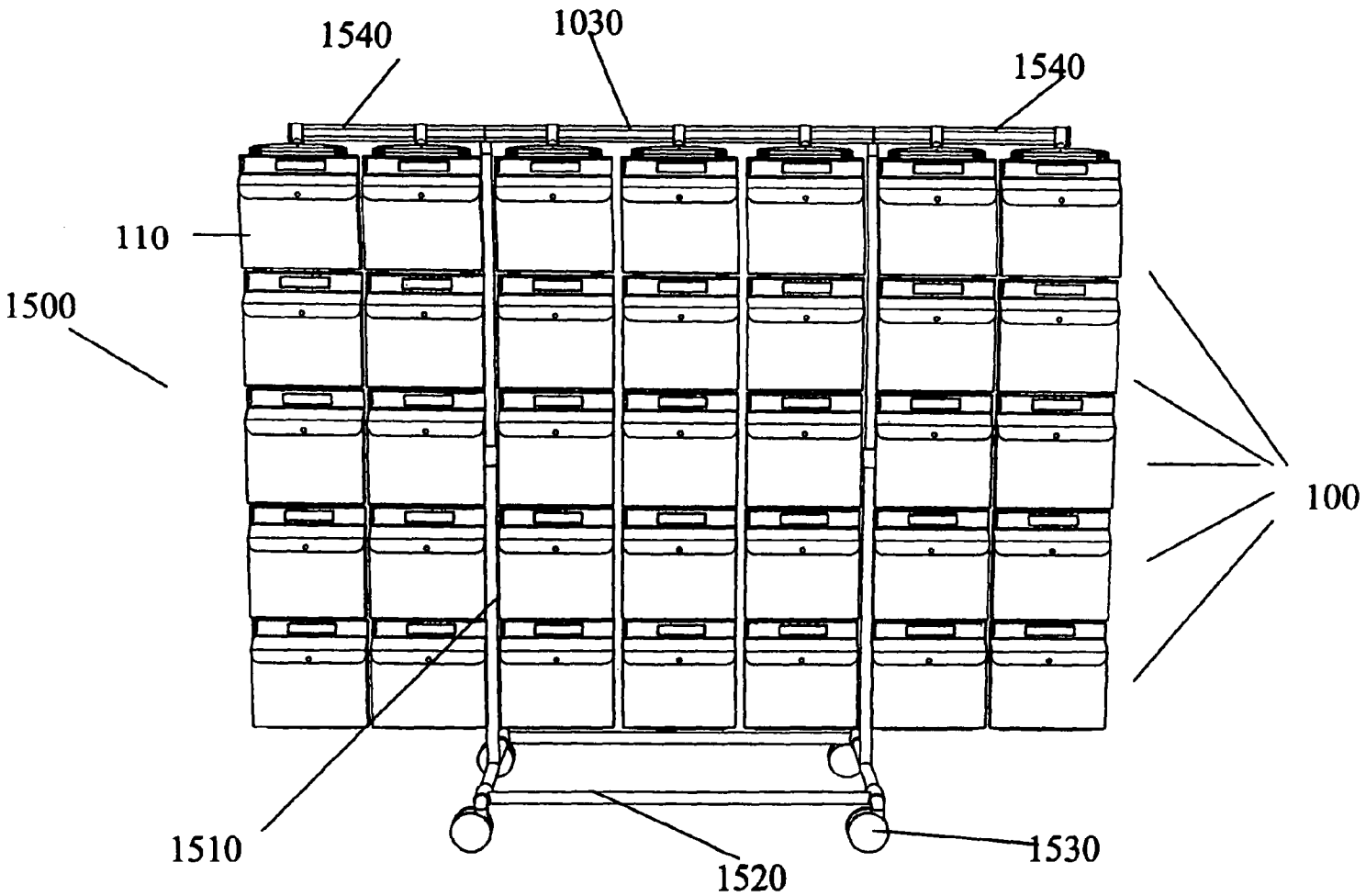
FIG. 15 illustrates an embodiment of a portable organization system.

FIG. 15 illustrates an embodiment of a portable organization system 1500 on a rack 1510 having wheels 1530. Portable organization system 1500 includes base supports 1520, rod 1030 and folding rods 1540. Portable organization system 1500 includes a plurality of visual organization systems 100 connected to one another and hanging from rod 1030 and folding rods 1540. In one embodiment folding rods 1540 can rotate 90 degrees (in two directions) or more. In another embodiment, folding rods 1540 are removably coupled to portable organization system 1500. Visual organization systems 100 rotate 360 degrees on portable organization system 1500. Wheels 1530 allow portable organization system 1500 to be moved to different locations for ease in portability.

Figure 16:
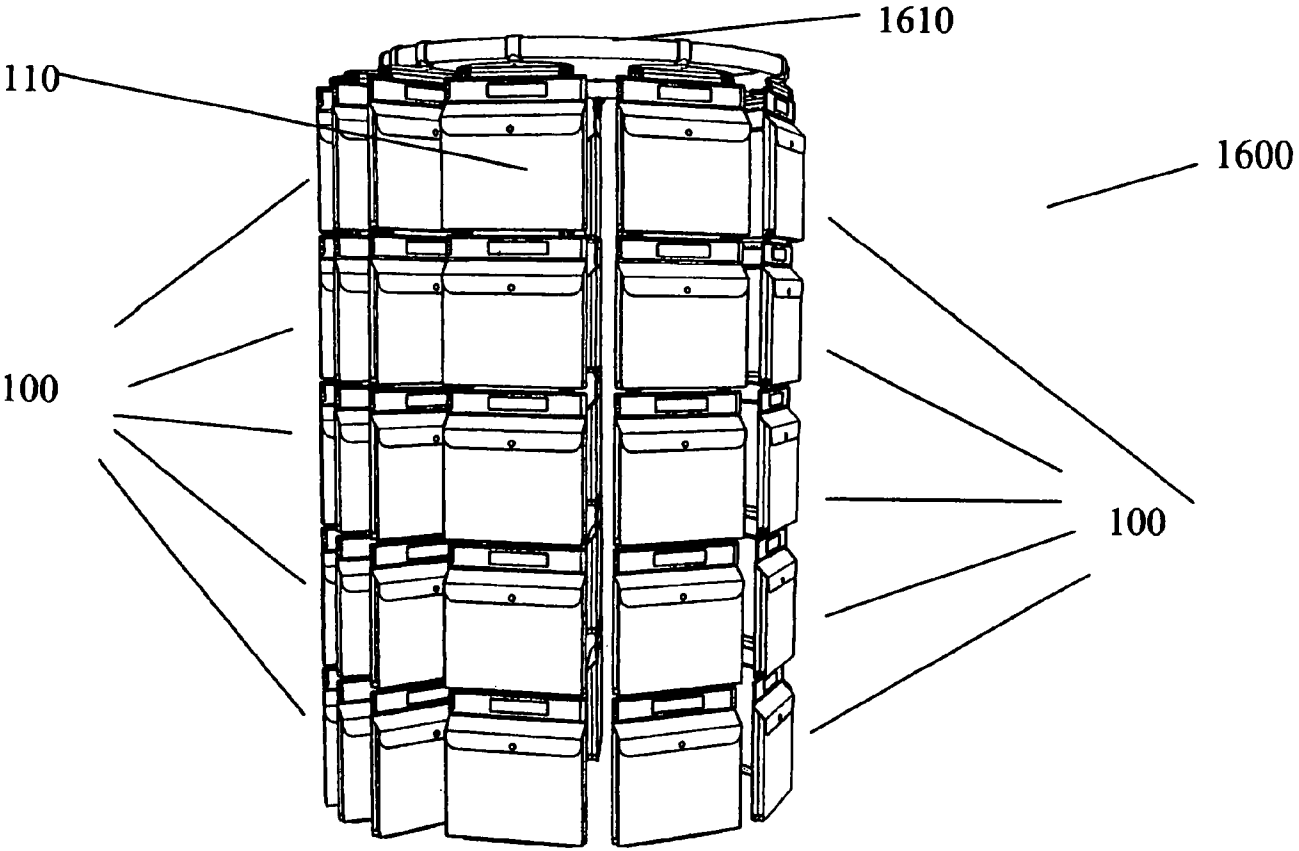
FIG. 16 illustrates an embodiment of a rotational organization system.

FIG. 16 illustrates a rotational organization system 1600. Rotational organization system 1600 includes circular rod 1610 holding a plurality of visual organization systems connected to one another (each having holder 110) and hanging from circular rod 1610 by removable slide hanger 905. In one embodiment, not only can each visual organization system slide and rotate on removable slide hanger 905, but rotational organization system 1600 can rotate 360 degrees.

Figure 17:
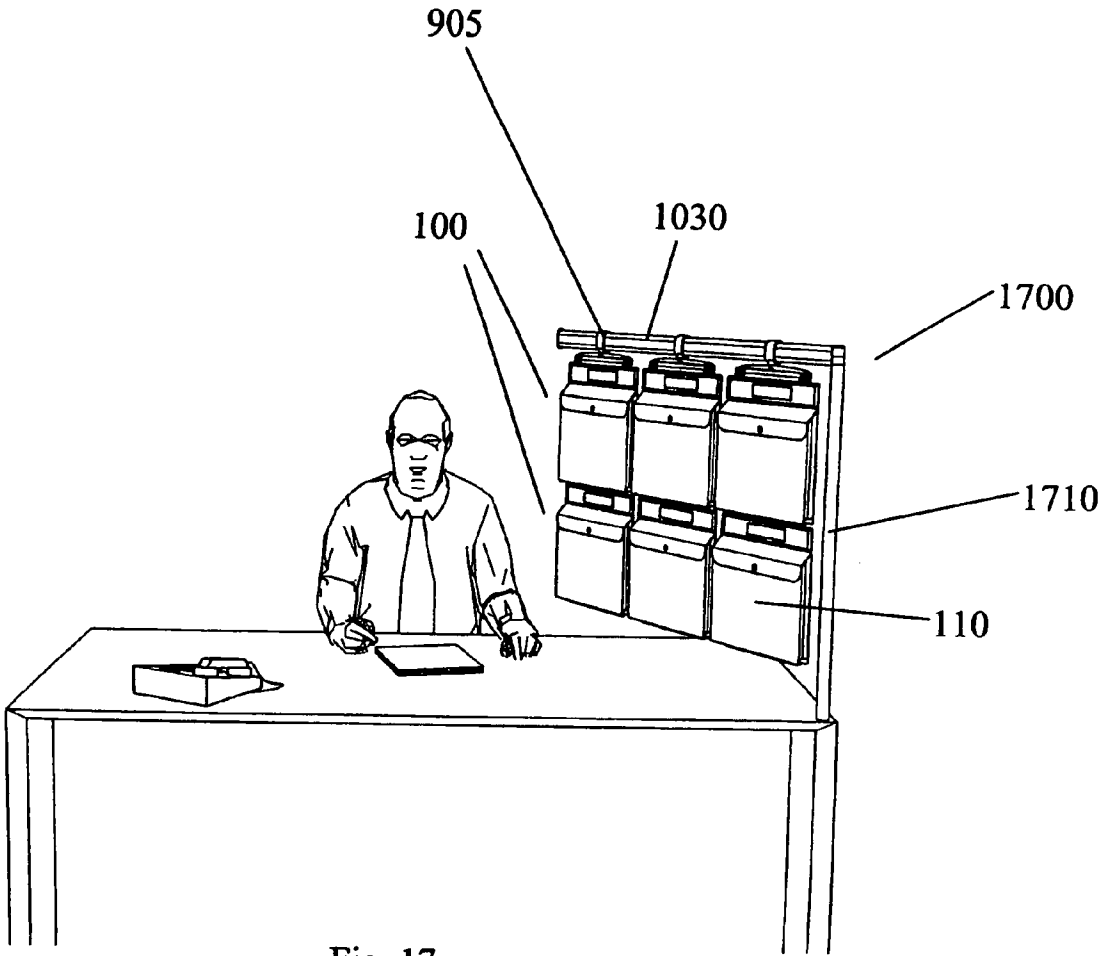
FIG. 17 illustrates an embodiment of a rotatable organization system.

FIG. 17 illustrates arm rotational organization system 1700. Arm rotational organization system 1700 includes swing arm 1710 that can rotate 360 degrees. Arm rotational organization system 1700 includes rod 1030 that can hold a plurality of visual organization systems 100 that hang from rod 1030 with removable slide hanger 905. Swing arm 1710 allows a plurality of visual organization systems 100 to be rotated towards or away from a person seated at a workstation for ease in organization and for space saving.

Figure 18:
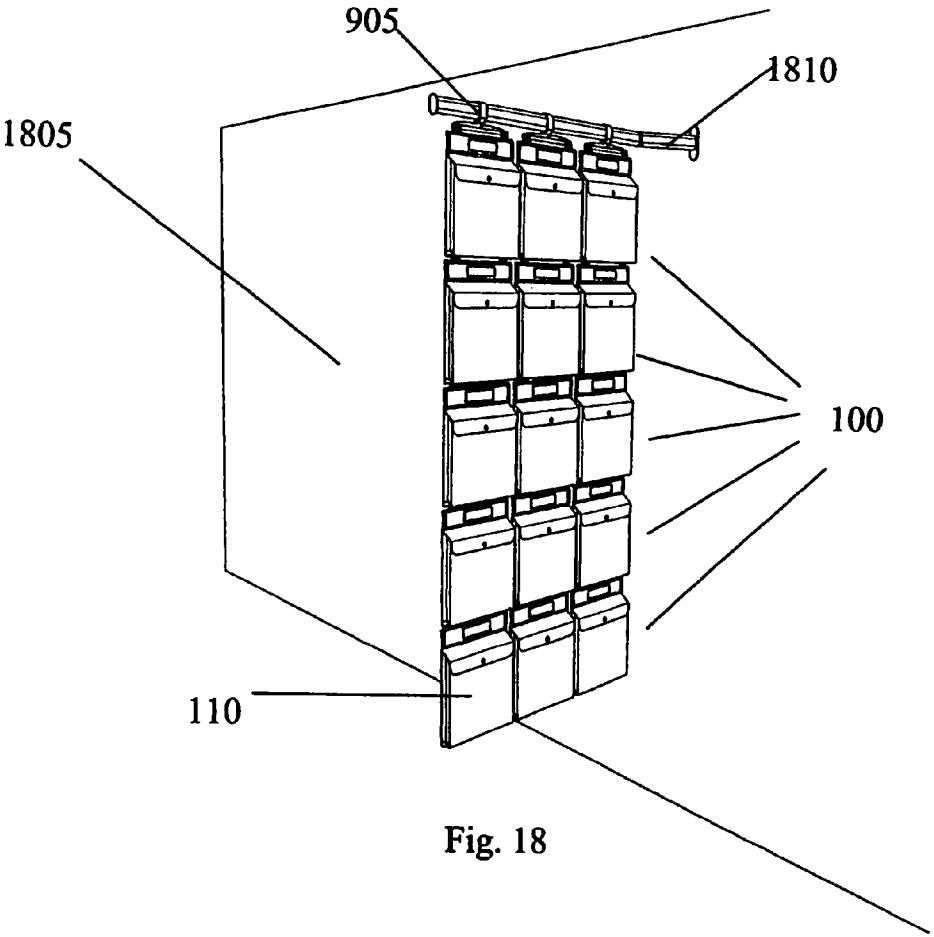
FIG. 18 illustrates an embodiment of a wall mounted organization system.

FIG. 18 illustrates wall extension rod 1810 perpendicularly connected to wall 1805. Removable slide hanger 905 connects to a visual organization system 100 that is connected to a plurality of other visual organization systems 100 where each include holder 110. In one embodiment a plurality of wall extension rods 1810 can be connected to wall 1805 to form aisles. Wall extension rod 1810 is linear.

Figure 19:
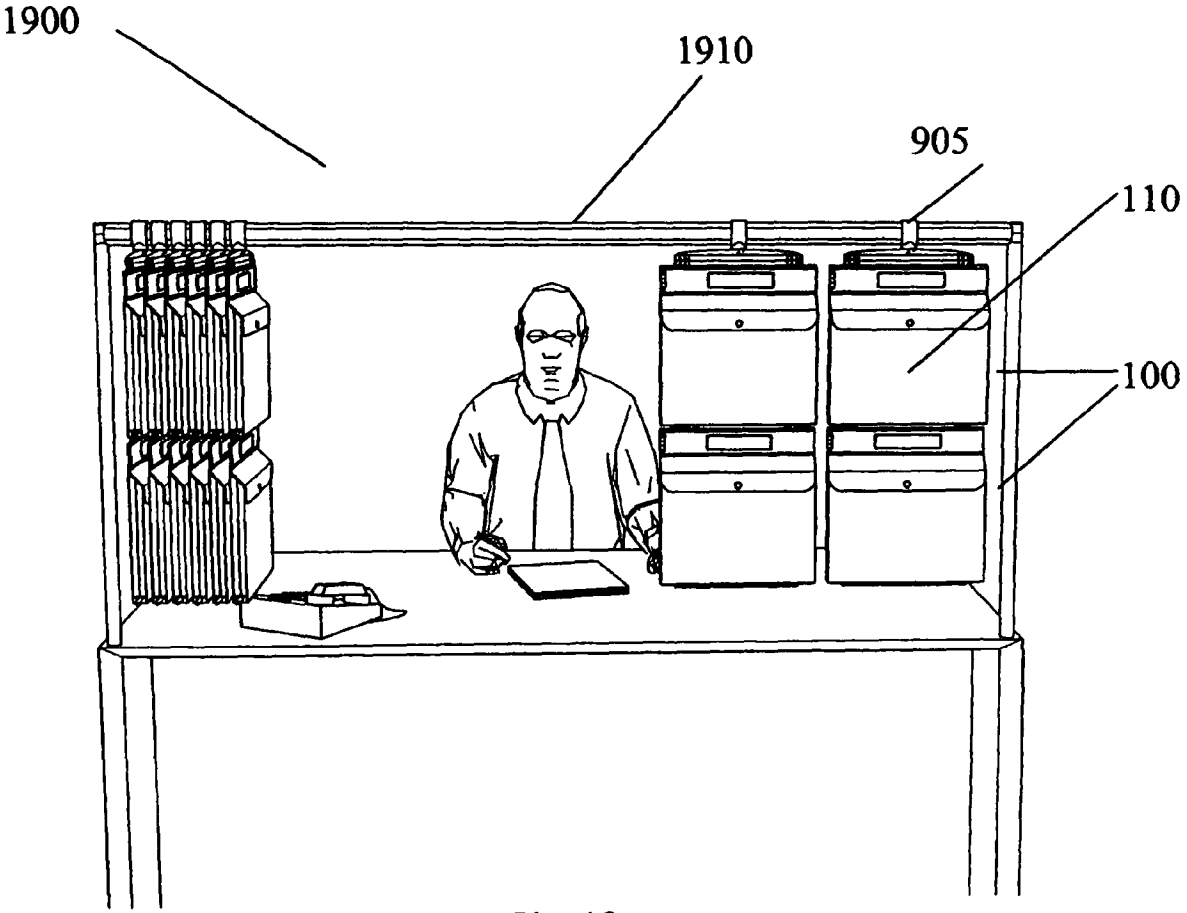
FIG. 19 illustrates an embodiment of a desk mounted organization system.

FIG. 19 illustrates stationary counter/workstation system 1900. Stationary counter/workstation system 1900 includes stationary rod 1910 holding a plurality of visual organization systems 100 each including holder 110. The visual organization systems 100 are connected to stationary rod 1910 by removable slide hanger 905. In one embodiment stationary counter/workstation system 1900 saves space and organizes articles in an efficient manner.

Figure 20A:
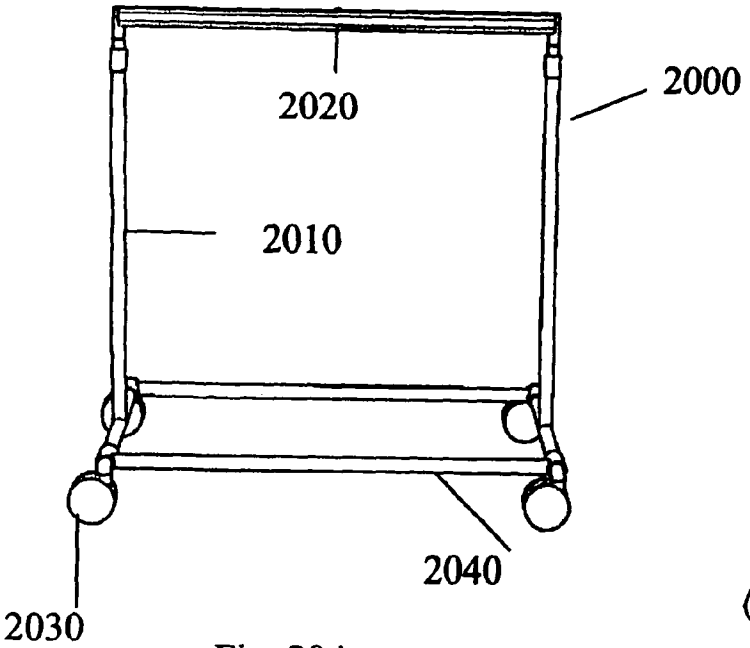
FIG. 20A illustrates an embodiment of a portable organization rack.

FIG. 20A illustrates folding rack 2000. Folding rack 2000 includes folding braces 2010, removable rod 2020, base support 2040 and wheels 2030. In one embodiment, folding rack 2000 is made of a metal, a metal alloy, a composite material, such as carbon fiber, etc. In one embodiment folding braces 2010 rotates on an axle between a set of wheels. In this embodiment folding braces 2010 can fold down 90 degrees to become parallel with base support 2040. In one embodiment removable rod 2020 is removable from the top of folding braces 2010. In this embodiment, coupling ends on removable rod 2020 fit within an end of folding braces 2010. In another embodiment coupling ends on removable rod 2020 fit over an end of folding braces 2010.

Figure 20B:
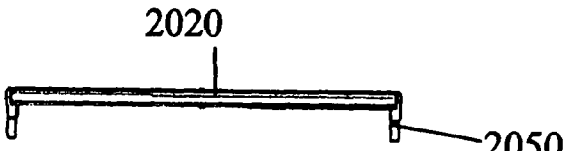
FIG. 20B illustrates a top portion of an embodiment of a portable organization rack.

FIG. 20B illustrates removable rod 2020. As illustrated, removable rod 2020 includes coupling ends 2050 that connect removable rod 2020 to folding braces 2010.

Figure 20C:
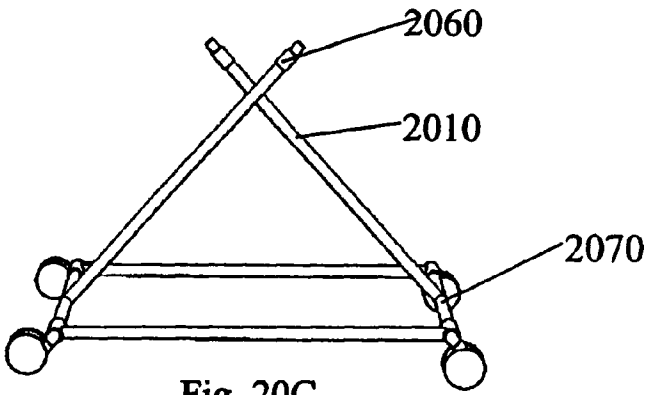
FIG. 20C illustrates a partially folded lower portion of an embodiment of a portable organization rack.

FIG. 20C illustrates folding rack 2000 without removable rod 2020. As illustrated folding braces 2010 include ends 2060 that connect with removable rod 2020. Rotational axle 2070 disposed between a set of wheels 2030 is illustrated rotated from a vertical position.

Figure 20D:
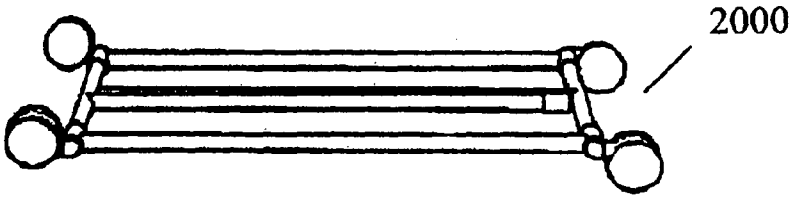
FIG. 20D illustrates a folded lower portion of an embodiment of a portable organization rack.

FIG. 20D illustrates folding rack 2000 in a completely folded state. In one embodiment folding rack 2000 allows easy storage for a folding rack 2000 that is suited to hold a plurality of visual organization systems 100 that are connected to removable rod 2000 by removable slide hangers 905.

Figure 21:
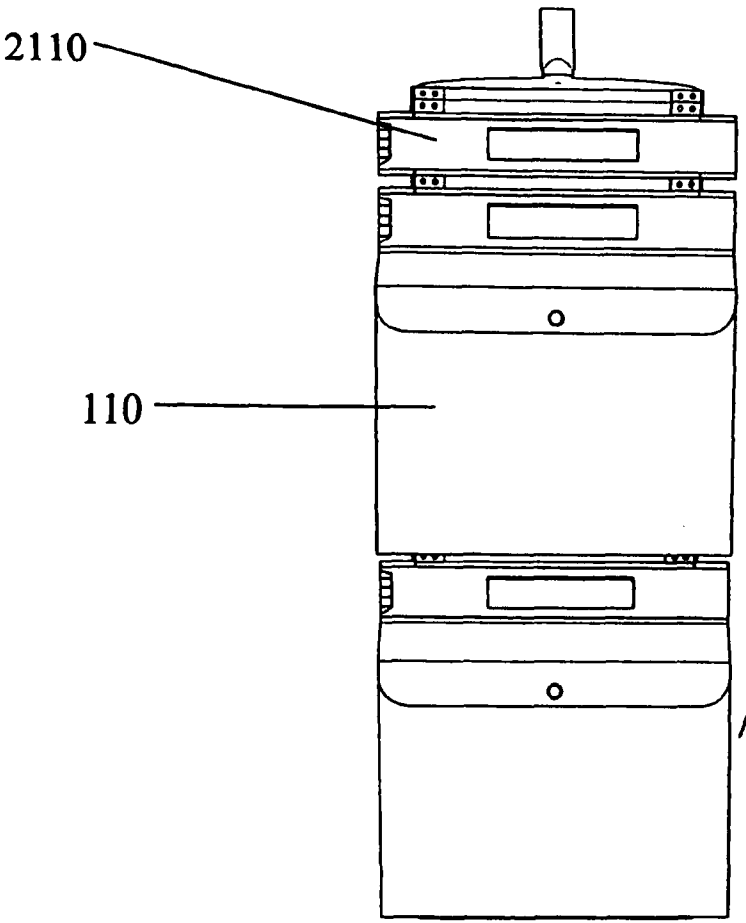
FIG. 21 illustrates two holders connected together with a note insert portion attached to the upper holder of an embodiment.

FIG. 21 illustrates a pair of visual organization systems 100 each having holder 110. The top visual organization system 100 includes identifier bracket 2110. In one embodiment identifier bracket 2110 is connected to a visual organization system 100 in the same or similar manner as other visual organization systems 100. In this embodiment identifier bracket 2110 does not have its own holder 110. In one embodiment identifier bracket 2110 includes first connector 120 and second connector 130.

Figure 22:
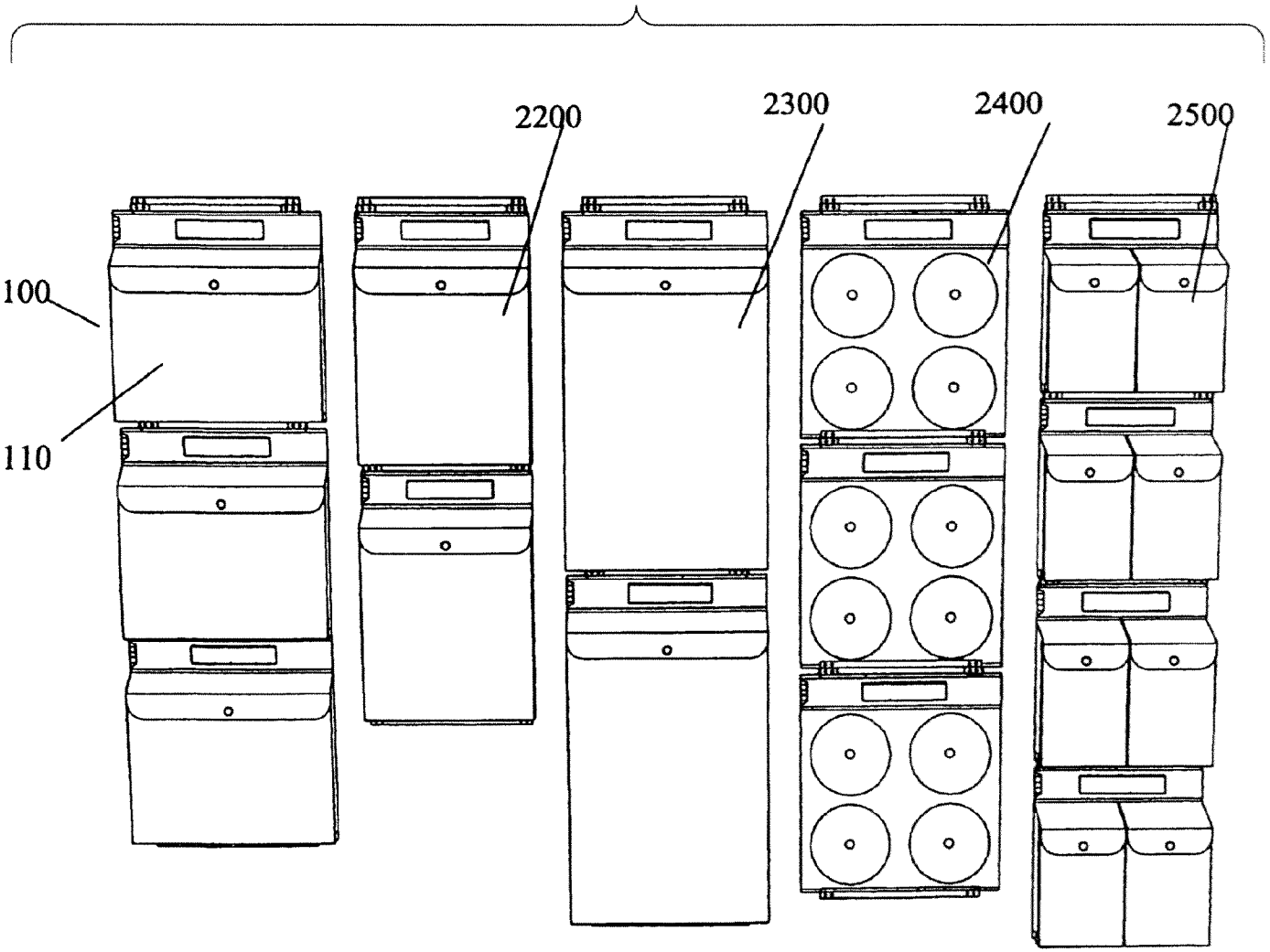
FIG. 22 illustrates different embodiments of holder devices.
Figure 23:
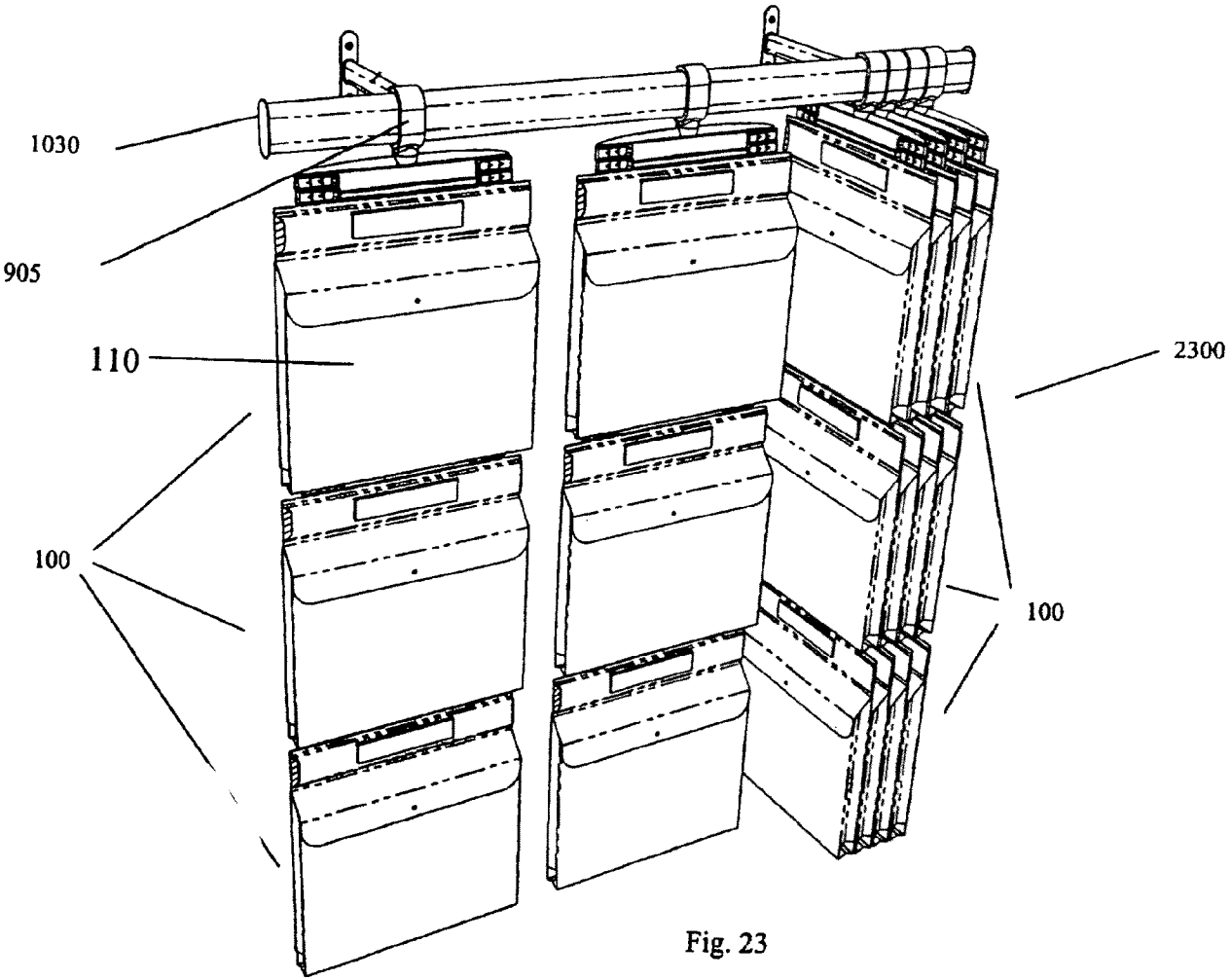
FIG. 23 illustrates an organizational system with multiple holders attached to one another and illustrating slidability and rotatability.

FIG. 22 illustrates a multitude of different configurations of visual organization systems. As illustrated visual organization systems 100 are shown with holder 110. Visual organization systems 2200 include longer and narrower holders than holder 110. FIG. 23 illustrates an organizational system with multiple holders attached to one another and illustrating slidablility and rotatability. Visual organization systems 2300 include wider and longer holders than holders 110.

Visual organization systems 2400 include a plurality of compact disc, digital versatile disc (DVD), etc. pockets within its holders. Visual organization system 2500 includes holders each including a pair of holders. It should be noted that other embodiments can include other configurations of holders included in a visual organization system.

Figure 24C:
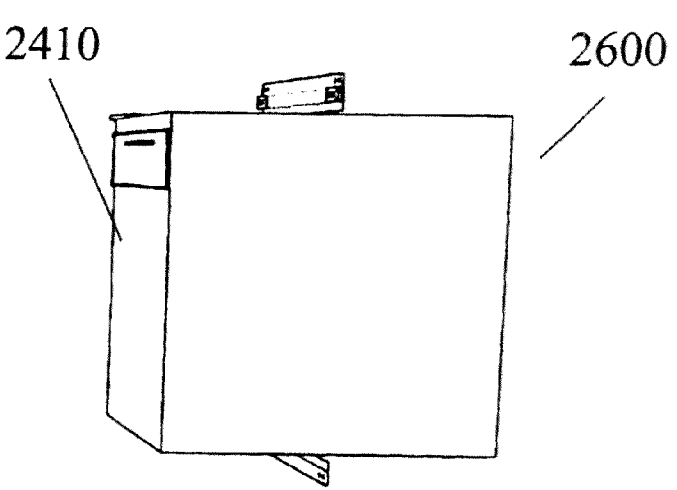
FIG. 24C illustrates a side view of the embodiment illustrated in FIG. 24A.
Figure 24D:
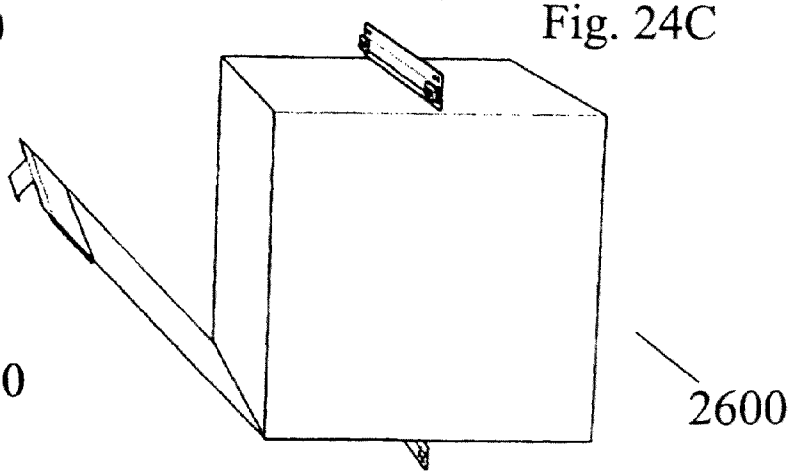
FIG. 24D illustrates a side view of the embodiment illustrated in FIG. 24A with a front panel opened.
Figure 24A:
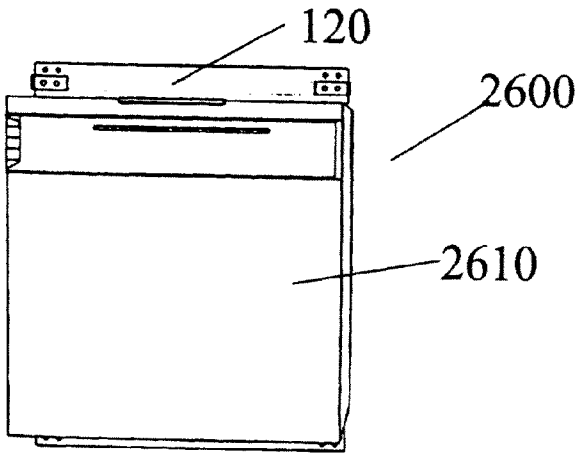
FIG. 24A illustrates a front view of an embodiment of an organizational display system.

FIG. 24A illustrates a front view of an embodiment of an organizational display system. In this embodiment, holder 2600 includes a fold-down portion (i.e., front panel) 2610. In one embodiment holder 2600 can hold and display objects. In this embodiment, holder 2600 is made of a clear, see-through material, such as clear vinyl, clear foldable plastic, plexi glass, etc. In one embodiment, fold-down portion 2610 snaps to the body of holder 2600 in a closed position. In another embodiment, hook and loop connectors are used to hold fold-down portion 2610 in a closed position. In yet another embodiment, snap locks are used to hold fold-down portion in a closed position. In one embodiment, a plurality of holders 2600 can be removably connected with the different handle, rack/bar (vertical/horizontal), etc., embodiments.

In one embodiment, holders 2600 can be attached to one another and carried by a handle, such as handle 1210. In one embodiment, in a retail or similar environment, items for resale/sale, etc. can be organized/displayed in holder 2600 and purchaser or worker can hold one or more holders 2600 by a handle, such as handle 1210. In this embodiment, the additional time to bag/box an item, cost of permanent shelving, cost of bags/boxes is eliminated. In another embodiment, the novelty of having a purchased item being displayed as a purchaser walks in a shopping area can induce other purchasers to buy similar items.

In one embodiment, different sides of holder 2600 can be colored or remain clear as desired for a visual effect. In one embodiment, a rear wall is colored or attached with a mirror type of material to enhance visual display. In another embodiment, different colored sidewalls assist in organizing a plurality of holders 2600 when attached to a rack and rotated. For example, a first color can identify a size/price of a clothing item, where a second color identifies another sized/priced clothing item. In other embodiments, the different color schemes can identify other determinant factors, e.g., age of items, type, sale/non sale items, etc.

Figure 24B:
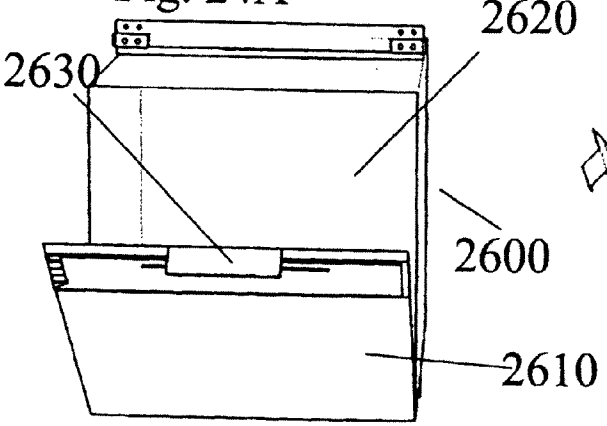
FIG. 24B illustrates the embodiment illustrated in FIG. 24A with a front panel opened.

FIG. 24B illustrates the embodiment illustrated in FIG. 24A with fold-down portion 2610 in an open position. As illustrated, holder 2600 includes gripping portion 2630 to open and close fold-down portion 2610.

FIG. 24C illustrates a side view of the embodiment illustrated in FIG. 24A. As illustrated, holder 2600 includes first connecting portion 120 and second connecting portion 130.

FIG. 24D illustrates a side view of the embodiment illustrated in FIG. 24A with fold-down portion 2610 opened. In one embodiment, holder 2600 has a square or rectangular shape. In other embodiment, holder 2600 includes other shapes, such as semi-circular, circular, other polygonal shapes, etc. In one embodiment, holder 2600 is sized as required to hold/display cups, hats, ornaments, glassware, silverware, sports items (e.g., sports balls), clothing, linens, food items (e.g., boxed/canned), books, magazines, newspapers, electronics, visual/audio media, vehicle components/accessories, etc.

Figure 25B:
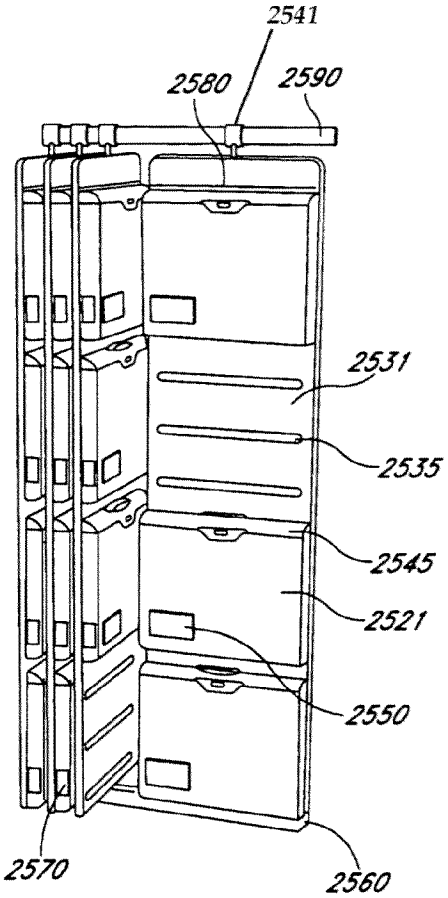
FIG. 25B illustrates the visual organizer system of FIG. 25A out of the cabinet.
Figure 25A:
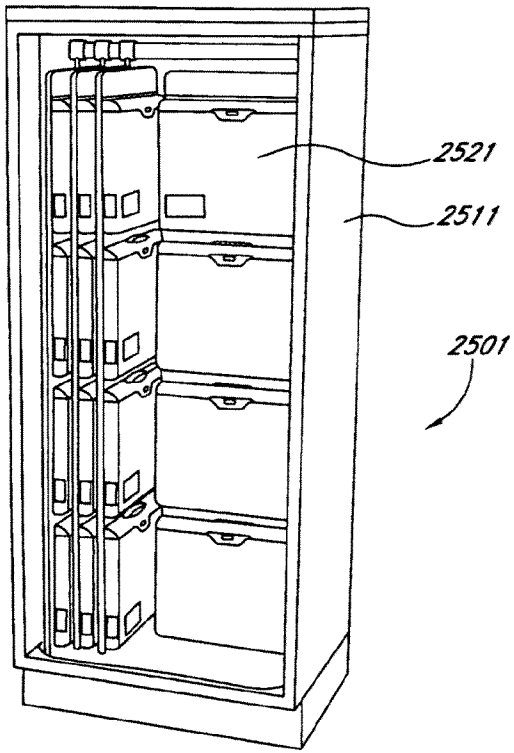
FIG. 25A illustrates a visual organizer system disposed in a cabinet.

FIG. 25A illustrates a visual organizer system 2501 disposed in a cabinet 2511. FIG. 25B illustrates visual organizer system 2501 out of cabinet 2511. Visual organizer system 2501 includes panel 2531. Panel 2531 can be made out of plastics, wood, metal, etc. In one embodiment, panel 2531 includes grooves 2535 for connecting container (holder) 2521 to panel 2531.

Container 2521 can removably connect to panel 2531 by placing connecting portions 2910 (see FIG. 29) in groove 2535. Multiple containers 2521 can be connected to or removed from panel 2531. Removable slide hanger 2541 has first portion 2610 rotatably coupled to panel 2531 and slidably connected to frame 2590. Content placed in container 2521 is viewable.

Container 2521 has lid 2545 to hold content inside of container 2521. In one embodiment, lid 2545 can be different colors for color coding container 2521. Lid 2545 has an integrated handle 2580 for grasping by a user. A notepad 2550 allows information to be written on the front of container 2521. Panel header 2620 (see FIG. 26) allows information about the panel to be inserted in a viewing portion of panel header 2621.

Rail 2560 connects with a pin 2710 (see FIG. 27) that slides in a groove in rail 2560 to keep panel 2531 from swinging on frame 2590. In one embodiment frame 2590 is made of a metal, wood, hardened plastic, etc. In one embodiment container 2521 is made of see-through material (e.g., plastic, vinyl, etc.) contains and displays objects. Container 2521 can vary in size and shape depending on the types of items desired to be organized or displayed.

Figure 26:
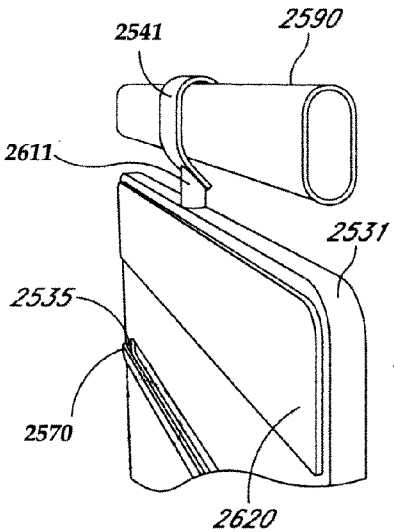
FIG. 26 illustrates a closer view of a panel.

FIG. 26 illustrates a closer view of panel 2531. As illustrated, panel 2531 has panel header 2620. The lower portion 2610 of hanger 2580 contains a swivel so panel 2531 can rotate. Hanger 2580 slides on frame 2590. In one embodiment frame 2590 is hollowed.

Figure 27:
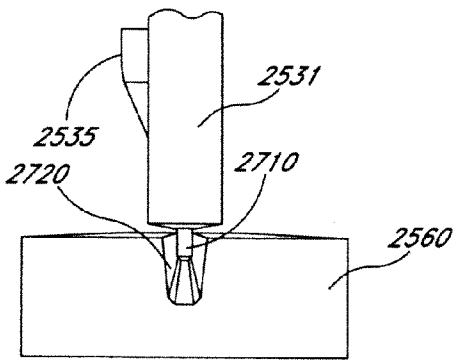
FIG. 27 illustrates a lower portion of a panel connected to a rail.

FIG. 27 illustrates a lower portion of panel 2531 connected to rail 2560. Pin 2710 fits into a groove 2720 in rail 2560. Panel 2531 is stabilized from swinging as pin 2710 remains in groove 2720.

Figure 28:
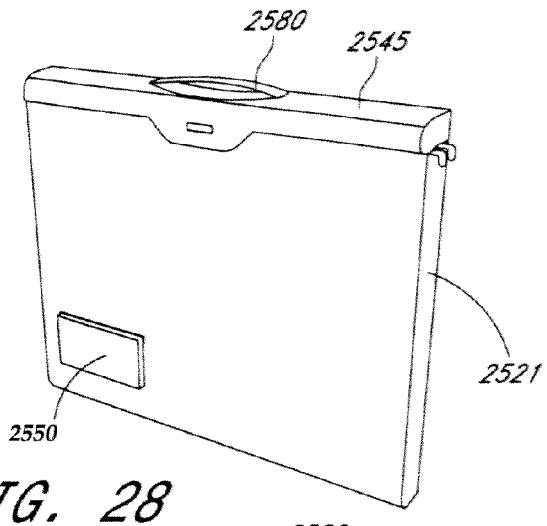
FIG. 28 illustrates a closer view of the front side of a container.
Figure 29:
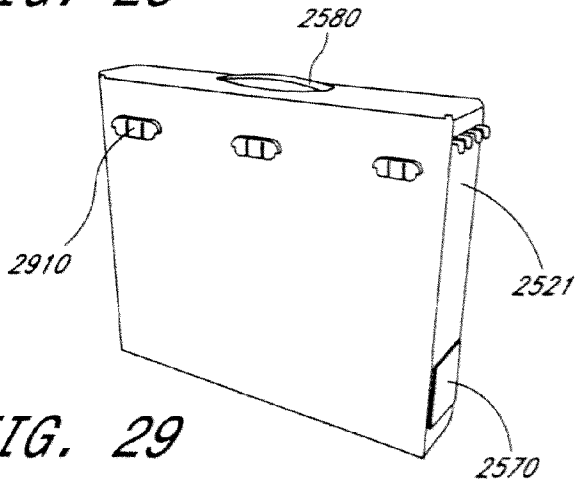
FIG. 29 illustrates the back of a container.

FIG. 28 illustrates a closer view of the front side of container 2521. FIG. 29 illustrates the back of container 2521. In one embodiment container 2521 has tab connectors 2910. Tab connectors 2910 fit into groove 2535 for easy connecting and removing from panel 2531.

Figure 30C:
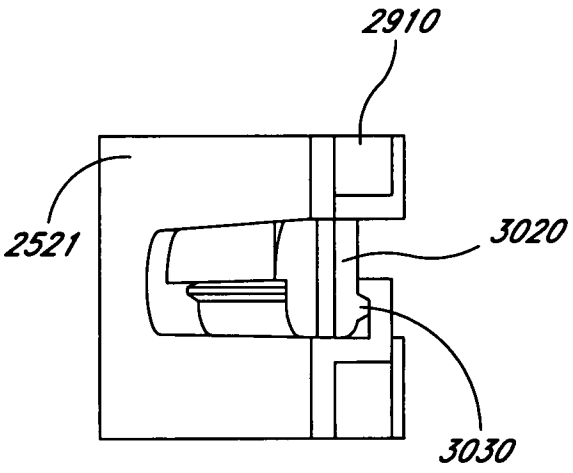
FIGS. 30A-C illustrates an isolated view of an embodiment of a tab connector.
Figure 30B:
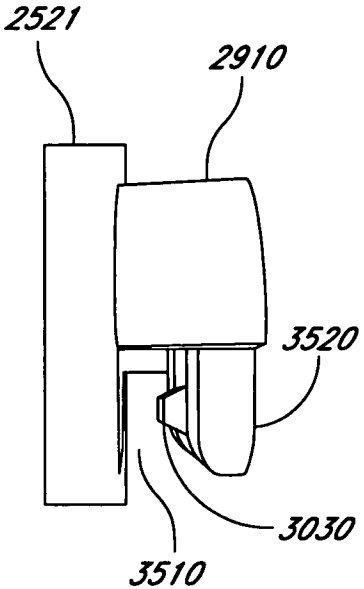
Figure 30A:
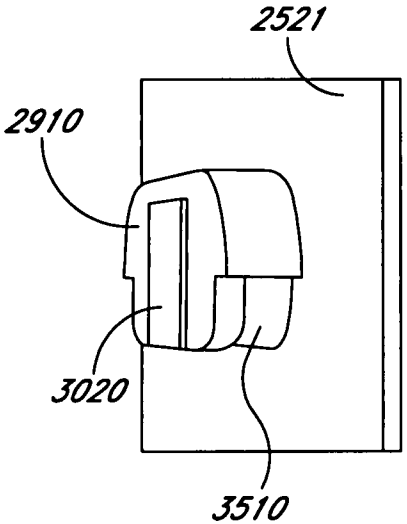

FIGS. 30A-C illustrate an isolated view of an embodiment of tab connector 2910. Connector 2910 includes a moveable part 3020. In one embodiment moveable part 3020 has a spring that allows moveable part 3020 to return to its original position when a force is removed from moveable part 3020. In this embodiment, when container 2521 has its tab connectors 2910 placed in groove 2535 tab connector 2910 is in its original position. Upon removing container 2521 from groove 2535 the moveable part 3020 moves to allow easy removal from groove 2535. Locking portion 3030 prevents container 2521 from easily falling out of groove 2535 if container 2521 has a force applied without intent of removing container 2521 from groove 2535.

Figure 31A:
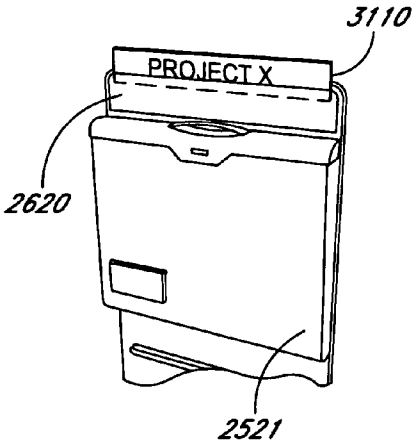
FIG. 31A illustrates a label being inserted into a panel header.
Figure 31B:
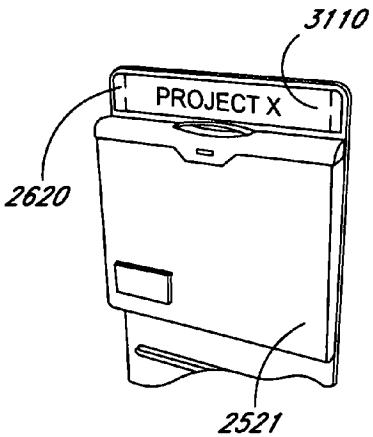
FIG. 31B illustrates a label inserted into the label header.

FIG. 31A illustrates label 3110 being inserted into panel header 2620. FIG. 31B illustrates label 3110 inserted into label header 2620. Panel header 2620 has an opening that allows label 3110 to easily be inserted into panel header 2620. Panel header 2620 is made of a clear material, such as vinyl, plastic, etc.

Figure 32:
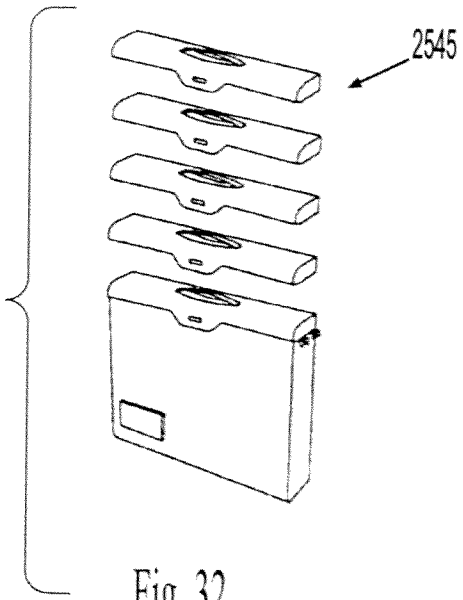
FIG. 32 illustrates examples of color coded lids.

FIG. 32 illustrates examples of color coded lids 2545. By using color coded lids 2545, users can distinguish categories for organization.

Figure 33A:
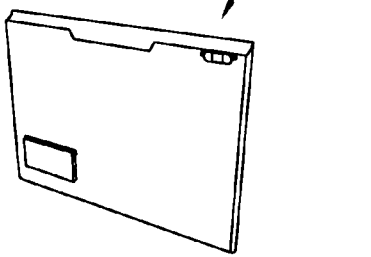
FIGS. 33A-G illustrate different embodiments of containers.
Figure 33C:
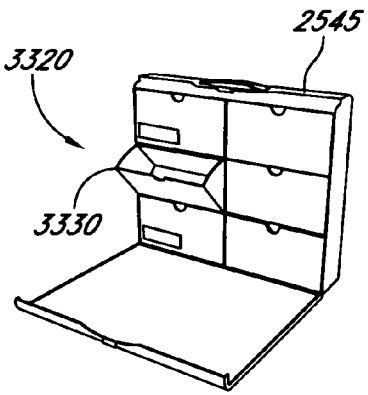
Figure 33B:
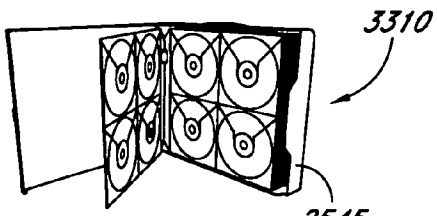
Figure 33D:
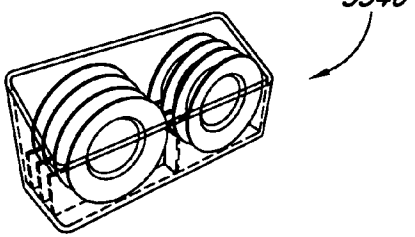

FIGS. 33A-G illustrate different embodiments of container 2521. Each of the embodiments illustrated in FIGS. 33A-G have tab connectors 2910 that removably couple with groove 2535. FIG. 33A illustrates basic container 2521 that is used for files. FIG. 33B illustrates container 3310 that is used for organizing disks (e.g., CDs, DVDs, etc.). FIG. 33C illustrates container 3320 having many compartments 3330 for organizing objects. In one embodiment, compartments 3330 tilt out from container 3320. FIG. 33D illustrates container 3340 that is used for organizing objects, such as dishes placed vertically into container 3340.

Figure 33E:
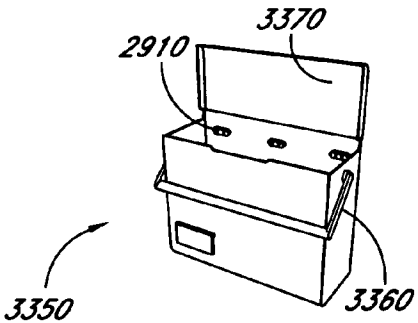
Figure 33F:
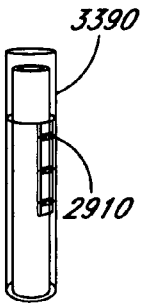

FIG. 33E illustrates container 3350. Container 3350 can be made of a rigid clear material, such as plastic, hardened plastic, acrylic, etc. Container 3350 includes a rotatable handle 3360. Container 3350 includes lid 3370 that snaps closed over the top of container 3350. FIG. 33F illustrates a tube container 3390. The shape of container 3390 can be used for items such as rolled up posters, maps, blue prints, etc. Lid 3390 can be a screw down type of lid; hinged type of lid or snap down type of lid.

Figure 33G:
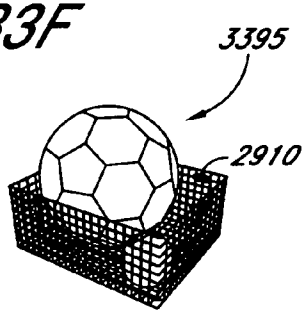

FIG. 33G illustrates container 3395. Container 3395 is a basket type of container. Container 3395 is used for organizing large objects (e.g., a soccer ball, basketball, clothing, etc. Container 3395 can be made out of metal, plastics, hardened plastics, etc.

Figure 34A:
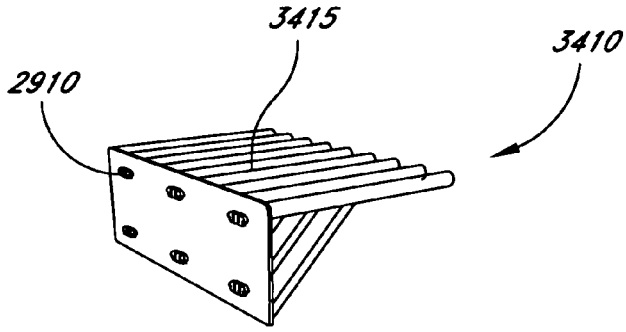
FIGS. 34A-D illustrate different embodiments of holders.
Figure 34B:
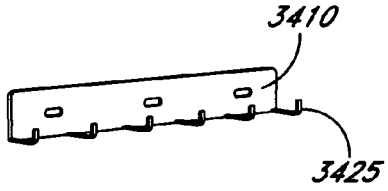

FIGS. 34A-D illustrate different embodiments of holders. FIG. 34A illustrates holder 3410 including rods 3415. Rods 3415 can be used for organizing objects, such as pants, ties, towels, etc. FIG. 34B illustrates holder 3410 including hooks 3425. Holder 3410 can be made out of metal, plastic, hardened plastic, etc. Holder 3410 is used for holding any object that typically is hanged from a hook.

Figure 34C:
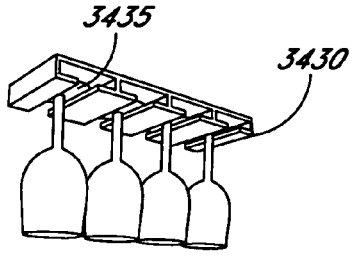
Figure 34D:
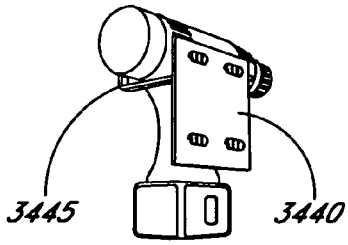

FIG. 34C illustrates holder 3430. Holder 3430 includes openings 3435 that are adapted to hold glasses with wide bases, such as wine glasses. Holder 3430 can be made out of wood, plastic, hardened plastic, etc. FIG. 34D illustrates holder 3440. Holder 3440 includes wide hooks 3445 (only one side illustrated). Holder 3440 includes tab connectors 2910. Holder 3440 is used to hold large items, such as electric tools (e.g., power drill), brooms, etc. Holder 3440 can be made out of metal, hardened plastic, plastic, etc.

Figure 35B:
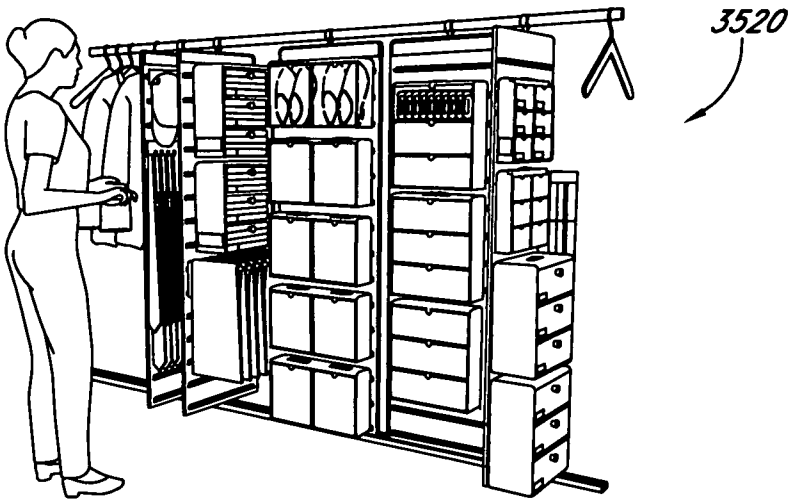
FIGS. 35A-D illustrate different uses for different embodiments of holders/containers.
Figure 35A:
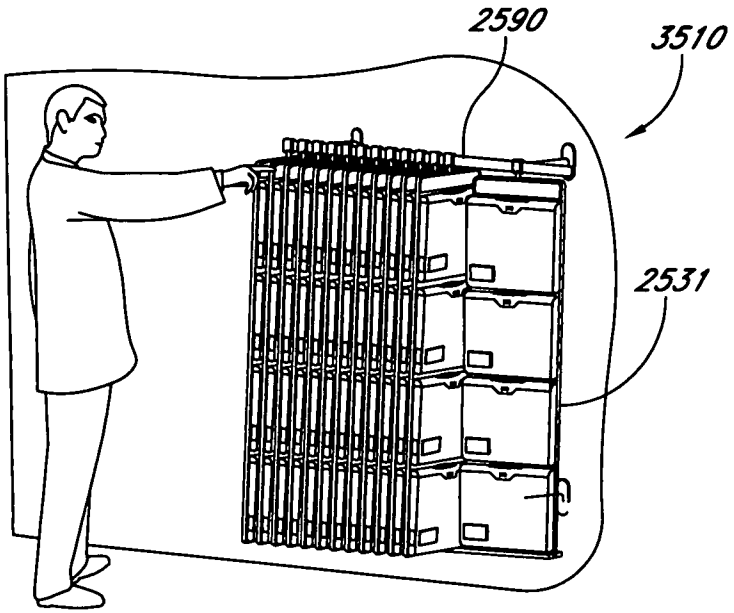

FIGS. 35A-D illustrate different uses for different embodiment of holders/containers. FIG. 35A illustrates organizer system 3510 that is attached to a wall with frame extended away from the wall to allow easy rotation of panel 2531. FIG. 35B illustrates organizing system 3520 that can be used for organizing closets, store displays, etc. Organizing system 3520 includes different embodiments of containers/holders for holding/containing objects, such as pants, shoes, belts, ties, hats, etc. All the items that are stored/placed in/on containers/holders can readily be seen.

Figure 35D:
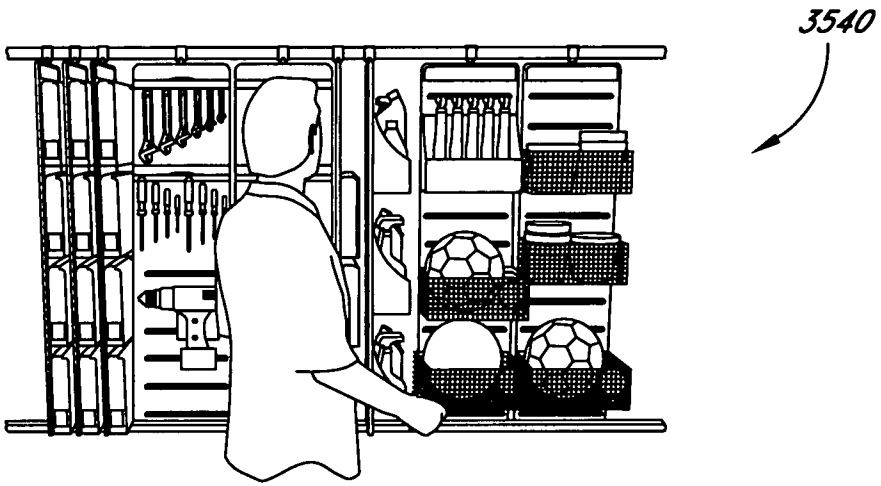
Figure 35C:
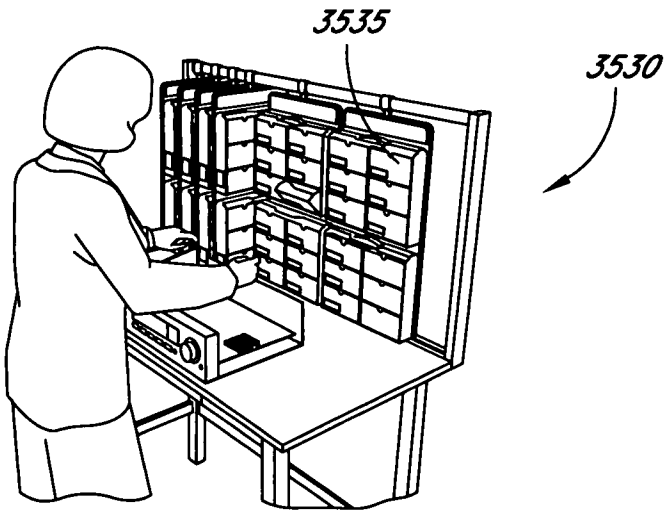

FIG. 35C illustrates organizing system 3530. Organizing system 3530 can be used as a workbench organizer. Containers 3535 can hold items such as hobby/crafts material, machining parts (e.g., nuts, bolts, screws, nails, etc.), or any other objects as desired. FIG. 35D illustrates organizing system 3540. Organizing system 3540 contains different types of holders/containers. Organizing system 3540 can be used in a garage to organize objects, such as tools, sports equipment, chemicals, etc.

Figure 36A:
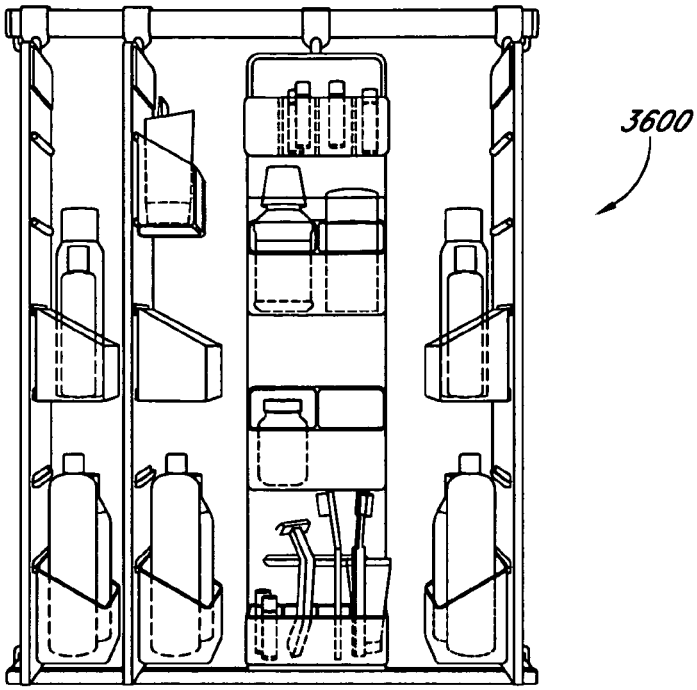
FIGS. 36A-D illustrate different embodiments of organizing systems.
Figure 36B:
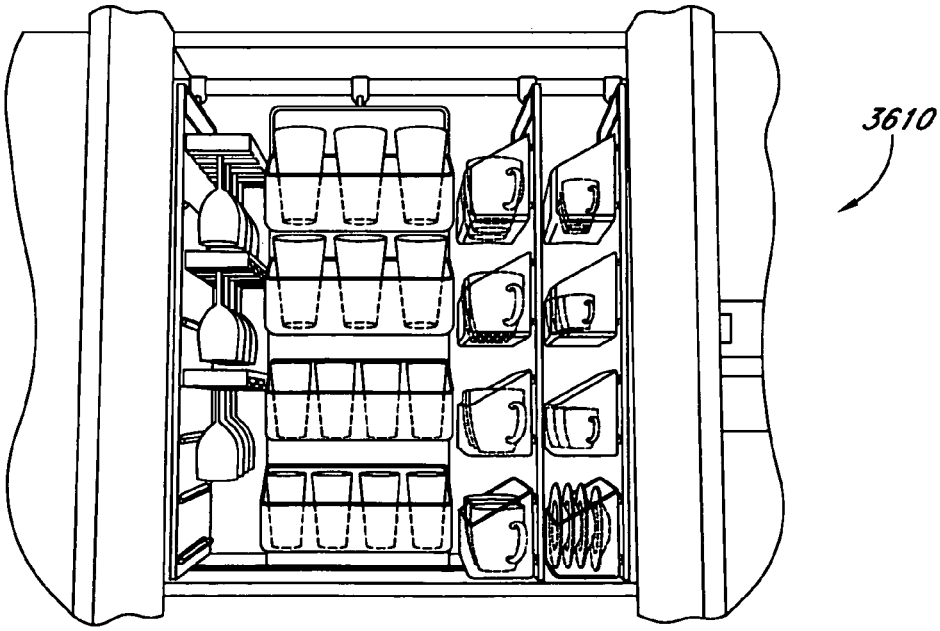
Figure 36C:
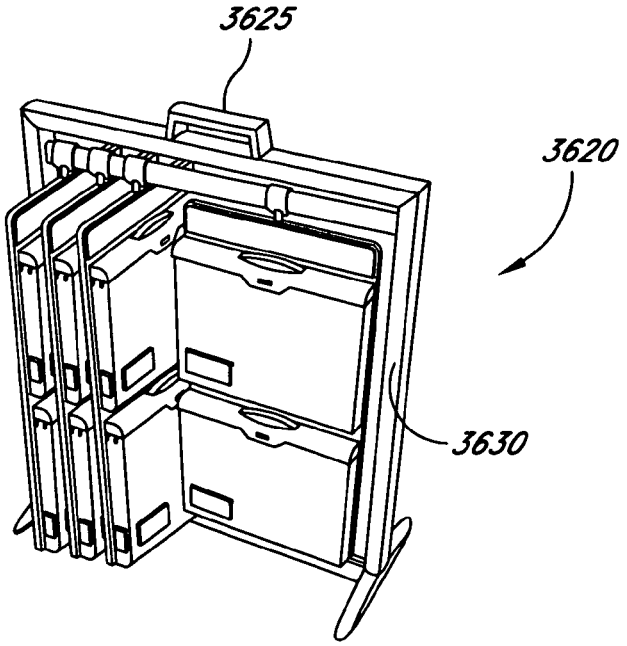

FIGS. 36A-D illustrate different embodiments of organizing systems. FIG. 36A illustrates organizing system 3600. Organizing system 3600 can be used in a medicine cabinet. FIG. 36B illustrates organizing system 3610. Organizing system 3610 can be used in a cabinet for organizing glasses, plates, silverware and other utensils, etc. FIG. 36C illustrates a portable organizing system 3620. Organizing system 3620 includes handle 3625 and rack 3630. Organizing system 3620 can be picked up and moved wherever needed as it is smaller than a basic organizing system, such as organizing system 2501.

Figure 36D:
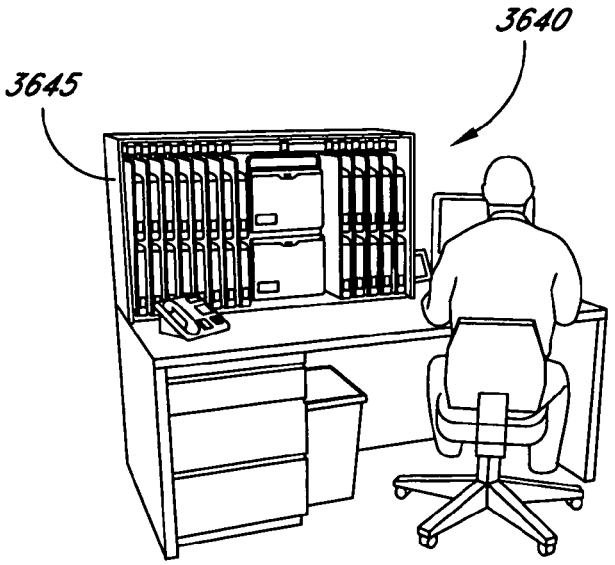

FIG. 36D illustrates organizing system 3640. Organizing system 3640 is sized to fit at a person's desk/work station. Organizing system 3640 is housed in a housing 3645 to match the environment.

Figure 38B:
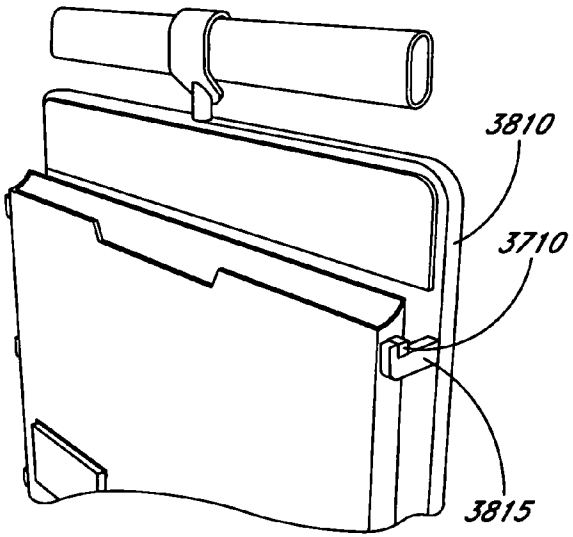
FIGS. 38A-B illustrates additional views of the embodiment illustrated in FIG. 37.
Figure 38A:
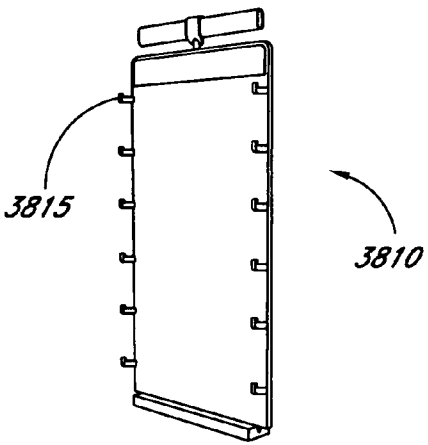
Figure 37:
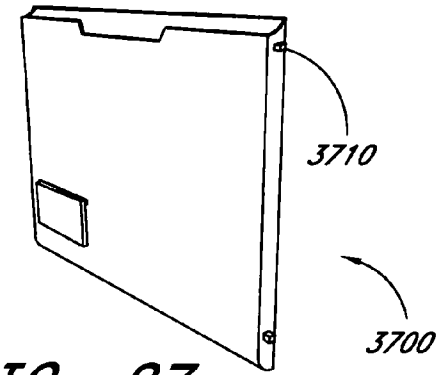
FIG. 37 illustrates an embodiment having different connection means for connecting a container/holder to a panel.

FIGS. 37 and 38A-B illustrate an embodiment having different connection means for connecting a container/holder to a panel. FIG. 37 illustrates container 3700. Container 3700 includes pegs 3710. FIG. 38A illustrates panel 3810 including hooks 3815. When holder 3700 is placed on panel 3810, hooks 3815 hold pegs 3710. FIG. 38B illustrates holder 3710 coupled with panel 3810.

Figure 41:
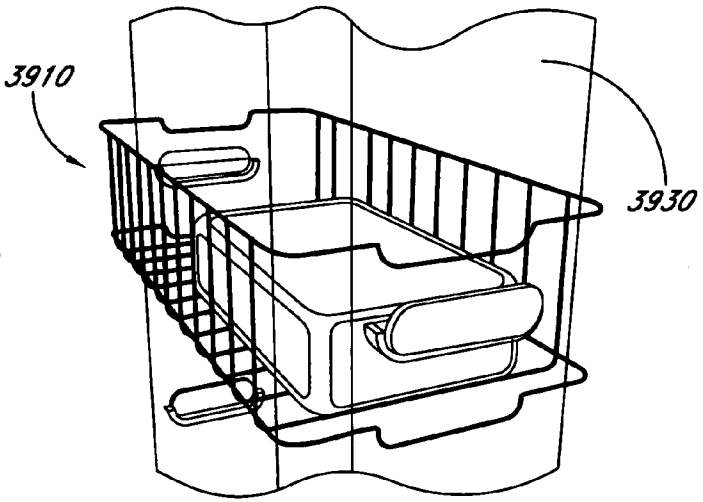
FIG. 41 illustrates the container illustrated in FIG. 39 being placed/dropped into the panel illustrated in FIG. 40.
Figure 40:
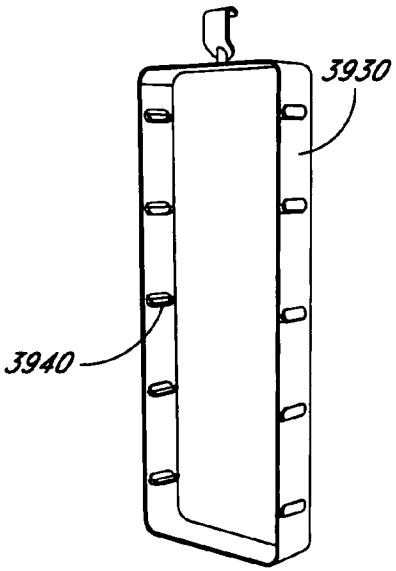
FIG. 40 illustrates an embodiment of a panel.
Figure 39:
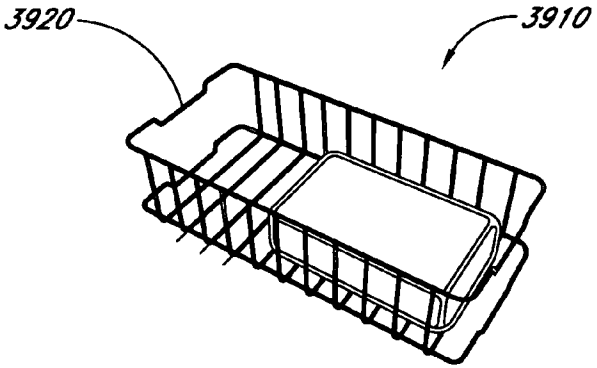
FIG. 39 illustrates an embodiment of a container.

FIG. 39 illustrates container 3910. Container 3910 includes connectors 3920. FIG. 40 illustrates panel 3930. Panel 3930 includes grooves 3940. Connectors 3920 intersect grooves 3940 when container 3910 is lowered into panel 3930. FIG. 41 illustrates container 3910 being placed/dropped into panel 3930. Panel 3930 is made from see through material, such as plastic, acrylic, etc.

Figure 43B:
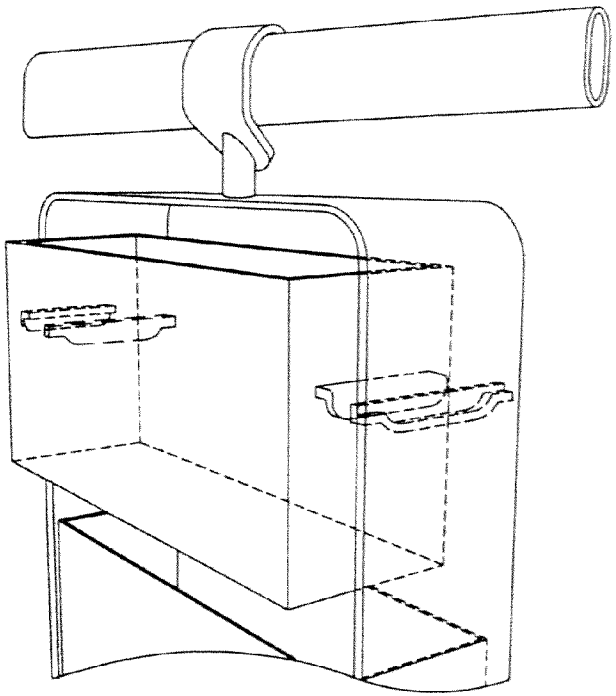
FIG. 43B illustrates the container illustrated in FIG. 42 being placed/dropped into the panel illustrated in FIG. 43A.
Figure 42:
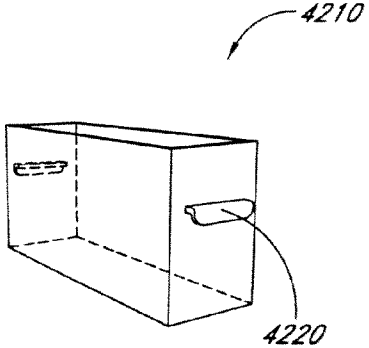
FIG. 42 illustrates an embodiment of a container.
Figure 43A:
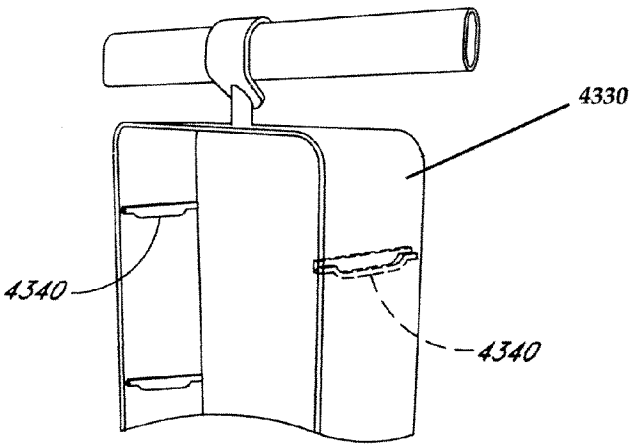
FIG. 43A illustrates an embodiment of a panel.

FIG. 42 illustrates container 4210. Container 4210 includes handles 4220. FIG. 43A illustrates panel 4330. Panel 4330 includes rails 4340. Handles 4220 slide onto rails 4340 when container 4210 is slid into panel 4330. FIG. 43B illustrates container 4210 being placed/slid onto panel 4330. Panel 4330 is made from see through material, such as plastic, acrylic, etc.

Figure 46A:
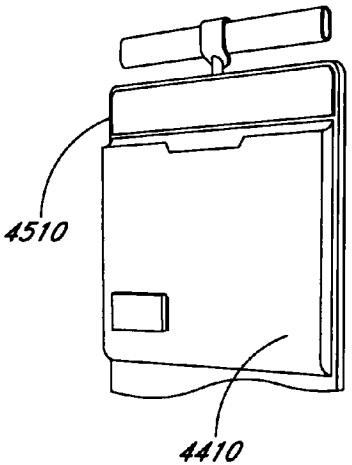
FIG. 46A illustrates an embodiment of a container connected to an embodiment of a panel.
Figure 46B:
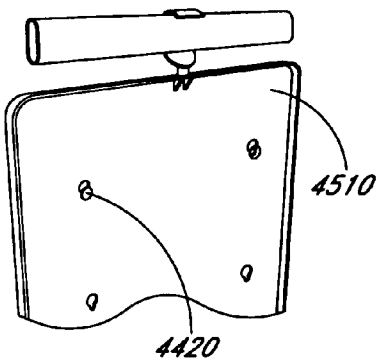
FIG. 46B illustrates the rear side of the panel illustrated in FIG. 45 with an embodiment of a container attached.
Figure 44:
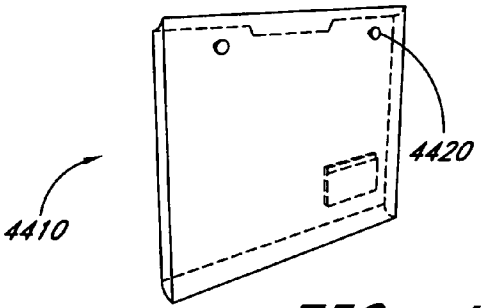
FIG. 44 illustrates another connection means for connecting a container/holder onto a panel.
Figure 45:
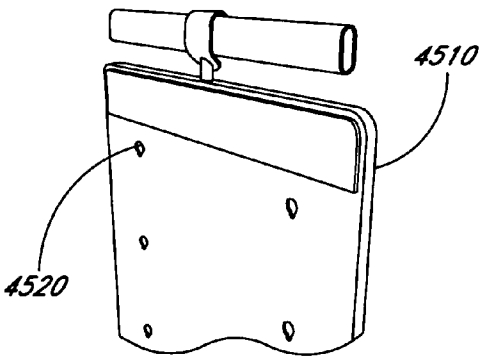
FIG. 45 illustrates panel 4510 including holes.

FIG. 44 illustrates another connection means for connecting a container/holder onto a panel. Container 4410 includes knobs 4420. FIG. 45 illustrates panel 4510 including holes 4520. Holes 4520 have an opening on the top of the hole that is wider than knob 4420. Knobs 4420 are placed into the upper portion of holes 4520 and then lowered a small distance. The lower portion of holes 4520 is narrower than the upper portion and connects with knobs 4420 to make a snug fit. When container 4410 is desired to be removed from panel 4510, container 4410 is first raised upward so that knobs 4420 are moved to the upper portion of holes 4520. Container 4410 is then horizontally removed from panel 4510. FIG. 46A illustrates container 4410 connected to panel 4510. FIG. 46B illustrates the rear side of panel 4510 with container 4410 attached. As illustrated, knobs 4420 are shown extruding through holes 4520.

Figure 47A:
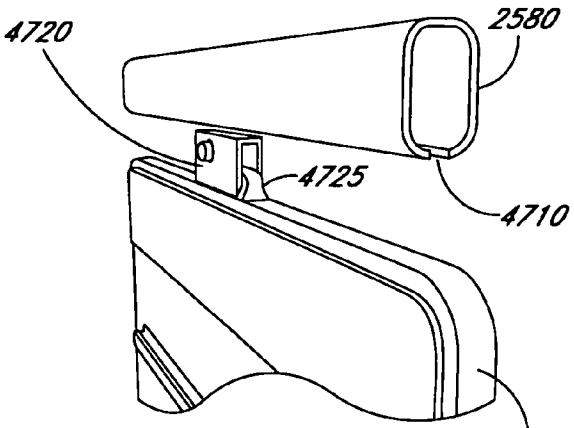
FIGS. 47A-B illustrate an embodiment of a panel connected with a clamp to a slide component.
Figure 47B:
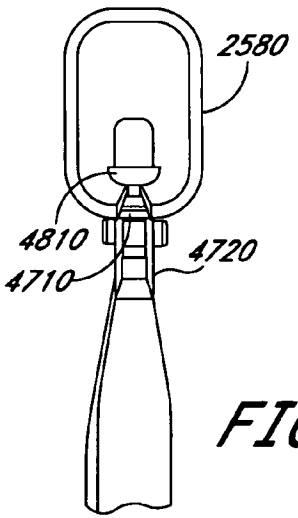

FIGS. 47A-B illustrates an embodiment where panel 4730 is connected with clamp 4720 that has a slide component 4810 that slides inside groove 4710 of frame 2580. As illustrated in FIG. 47B, slide component 4810 has an upper portion that is wider than groove 4710. In this embodiment, panel 4730 includes connection portion 4725 that connects to clamp connectors 4830 (see FIGS. 48A-B).

Figure 48B:
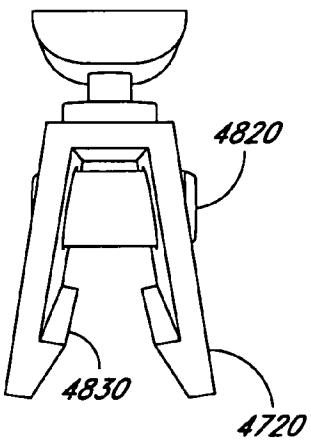
FIG. 48B illustrates an isolated view of an embodiment of a clamp in an open position.
Figure 48A:
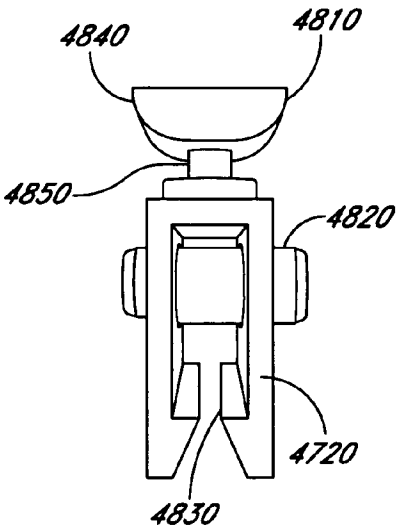
FIG. 48A illustrates an isolated view of an embodiment of a clamp in a closed position.

FIG. 48A illustrates an isolated view of clamp 4720. As illustrated upper portion 4840 of slide component is wider than lower portion 4850. Lower portion 4850 slides in groove 4710. As illustrated in FIG. 48A, clamp 4720 is in a closed position. In one embodiment upper portion 4840 is curved to match the curvature of the lower portion of frame 2580 to increase sliding smoothness. FIG. 48B illustrates clamp 4720 in an opened position. In the opened position, connection portion 4725 of panel 4730 can be removed or inserted into clamp 4720. When both sides of buttons 4820 are squeezed, clamp 4720 has clamp connectors 4830 spread apart. Typical engaging/releasing means can be used for clamp 4720 opening/closing (e.g., springs, etc.). Clamp 4720 can be made from any combination of metal, plastic, hardened plastic, etc.).

Different embodiments of visual organization systems relieve clutter; offer a visual system for organization offices, desks, workstations, counters, etc.; provide a place for interim files; speeds up decision making of where to drop active/interim files due to visualization of contents/objects; speeds up sorting and grouping as a global visual view of the contents in the holder(s); speeds up file retrieval of active documents with visual cues; decreases training time of a filing/organization system; assists with multitasking by providing a visual organization/display system; and provides a visual organization strategy to improve worker efficiency, reduces office space requirements, and reduces time top find items.

Reference in the specification to "an embodiment," "one embodiment," "some embodiments," or "other embodiments" means that a particular feature, structure, or characteristic described in connection with the embodiments is included in at least some embodiments, but not necessarily all embodiments. The various appearances of "an embodiment," "one embodiment," or "some embodiments" are not necessarily all referring to the same embodiments. If the specification states a component, feature, structure, or characteristic "may", "might", or "could" be included, that particular component, feature, structure, or characteristic is not required to be included. If the specification or claim refers to "a" or "an" element, that does not mean there is only one of the element. If the specification or claims refer to "an additional" element, that does not preclude there being more than one of the additional element.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art.

What is claimed is:

1. A system comprising:

at least three panels;

a plurality of holders, each of the plurality of holders arranged vertically with respect to each other, each of said holders including at least one connecting portion for removably connecting to one of said at least three panels, each said panel having a corresponding receiving portion for each of said connecting portions;

a plurality of hanger devices each directly coupled to a top portion of a corresponding one of the panels and to a frame; and a single rail device coupled to a plurality of coupling devices, each of said coupling devices disposed on a bottom portion of a corresponding one of the panels, wherein each panel has a vertical axis, and wherein said hanger devices and said coupling devices are configured to enable each of the panels to rotate about the vertical axis of the respective panel and slide on the frame along a single horizontal axis of the frame, wherein at least two adjacent panels of the at least three panels are simultaneously rotatable 360° about said vertical axes, respectively, and each of said holders of said at least two adjacent panels are simultaneously accessible when said panels at least two adjacent are rotated to be in a position which is parallel to said frame and said rail device.

2. The system of claim 1, wherein each panel corresponding receiving portion includes a groove to removably couple with the at least one connecting portion.

3. The system of claim 1, wherein each panel corresponding receiving portion includes parallel hooks to removably couple with the at least one connecting portion.

4. The system of claim of claim 1, wherein each panel corresponding receiving portion includes parallel holes to removably couple with the at least one connecting portion.

5. The system of claim 1, further including each said hanger device having a hook portion and a rotational portion, wherein the hook portion slides on the frame.

6. The system of claim 1, further including each said hanger device having a slide portion and a clamp portion, wherein the slide portion slides within the frame.

7. The system of claim 1, wherein each of the plurality of holders is one of a file holder, a compact disk holder, a basket, a tube, a container, a glass rack, and a hook rack.

8. The system of claim 1, wherein each of the plurality of holders are made of a clear material.

9. The system of claim 1, wherein the plurality of holders each include a gripping portion and a fold-down portion.

* * * * *

UNITED STATES PATENT AND TRADEMARK OFFICE

CERTIFICATE OF CORRECTION

PATENT NO. : 8,439,211 B2
APPLICATION NO. : 11/388469
DATED : May 14, 2013
INVENTOR(S) : Ray R. Emrani and Gregory E. Mote It is certified that error appears in the above-identified patent and that said Letters Patent is hereby corrected as shown below:

In the Claims

Column 12, Claim 1, line 24, please delete "adjacent are" and insert --adjacent panels are--.

Column 12, Claim 4, line 32, after "system" please delete "of claim".

Signed and Sealed this
Third Day of September, 2013

Teresa Stanek Rea
*Acting Director of the United States Patent and Trademark Office*